US009019325B2

(12) United States Patent
Kobayashi et al.

(10) Patent No.: US 9,019,325 B2
(45) Date of Patent: Apr. 28, 2015

(54) LIQUID CRYSTAL DISPLAY DEVICE

(71) Applicant: Panasonic Liquid Crystal Display Co., Ltd., Hyogo (JP)

(72) Inventors: Takahiro Kobayashi, Osaka (JP); Yoshio Umeda, Hyogo (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 171 days.

(21) Appl. No.: 13/721,213

(22) Filed: Dec. 20, 2012

(65) Prior Publication Data

US 2013/0162697 A1 Jun. 27, 2013

(30) Foreign Application Priority Data

Dec. 21, 2011 (JP) ..... 2011-280351

(51) Int. Cl.
*G09G 3/36* (2006.01)

(52) U.S. Cl.
CPC ..... *G09G 3/3648* (2013.01); *G09G 3/3611* (2013.01); *G09G 3/3614* (2013.01); *G09G 2320/0204* (2013.01); *G09G 2360/16* (2013.01)

(58) Field of Classification Search
CPC ..... G09G 3/3648; G09G 2360/16; G09G 3/3611; G09G 2320/0204; G09G 3/3614; H04N 5/147; H04N 7/0127
USPC ..... 345/50, 53, 54, 204, 208, 209, 690, 345/87–96; 349/37
See application file for complete search history.

(56) References Cited

U.S. PATENT DOCUMENTS

| | | | | |
|---|---|---|---|---|
| 2005/0001907 | A1* | 1/2005 | Hoshuyama | 348/222.1 |
| 2005/0184944 | A1* | 8/2005 | Miyata et al. | 345/89 |
| 2007/0195045 | A1 | 8/2007 | Kaneki | |
| 2008/0309656 | A1* | 12/2008 | Van Woudenberg et al. | 345/214 |
| 2010/0026678 | A1* | 2/2010 | Sakashita | 345/213 |

FOREIGN PATENT DOCUMENTS

JP 2007-225861 9/2007

* cited by examiner

*Primary Examiner* — Alexander Eisen
*Assistant Examiner* — Abhishek Sarma
(74) *Attorney, Agent, or Firm* — Wenderoth, Lind & Ponack, L.L.P.

(57) ABSTRACT

A liquid crystal display device includes: a liquid crystal display unit including pixels and displaying an image based on an input image signal; a drive unit that applies a voltage based on the input image signal to the pixels while inverting a polarity of the voltage for each of frames; a luminance determination unit that determines whether a detected average luminance has changed, between the frames, by an amount equal to or more than a reference luminance; and a signal generation unit that generates a phase inversion enabling signal for inverting a phase of the polarity of the voltage applied to the pixels, in a case where the luminance determination unit determines that the average luminance has changed by the above amount, wherein the drive unit inverts the phase of the polarity of the voltage applied to the pixels when the phase inversion enabling signal is generated.

7 Claims, 20 Drawing Sheets

FIG.3

| FRAME | F1 | F2 | F3 | F4 | F5 | F6 | F7 | F8 |
|---|---|---|---|---|---|---|---|---|
| LUMINANCE AVERAGE VALUE (0 TO 255) CALCULATED BY AVERAGE LUMINANCE COMPUTING CIRCUIT 31 | 50 | 50 | 50 | 50 | 60 | 60 | 60 | 60 |
| OUTPUT SIGNAL LEVEL OF COMPARISON CIRCUIT 34 | LOW | LOW | LOW | LOW | HIGH | LOW | LOW | LOW |
| PHASE INVERSION TIMING | | | | | INVERT | | | |
| LUMINANCE AVERAGE VALUE (0 TO 255) OF OUTPUT IMAGE SIGNAL DELAYED BY FRAME MEMORY 25 | — | 50 | 50 | 50 | 50 | 60 | 60 | 60 |

FIG.5

| | PHASE INVERSION STATE | PHASE INVERSION ENABLING PERIOD (FRAME) | ACTUAL PHASE INVERSION CYCLE (FRAME) | EXCESS OR DEFICIENCY OF CYCLE (FRAME) | SUBSEQUENT TARGET VALUE (FRAME) |
|---|---|---|---|---|---|
| FIRST TIME | − | 5～50 | N1＝12 | 0 | 12 |
| SECOND TIME | ＋ | 12±6 | N2＝10 | −2 | 8 |
| THIRD TIME | − | 8±6 | N3＝14 | ＋6 | 20 |
| FOURTH TIME | ＋ | 20±6 | | | |

LIQUID CRYSTAL DISPLAY DEVICE

BACKGROUND

1. Technical Field

This disclosure relates to a liquid crystal display device that displays a video picture on a liquid crystal display unit.

2. Description of the Related Art

In a liquid crystal display unit, it is known that, when a direct-current (DC) drive voltage is applied to pixels including liquid crystals in order to drive the pixels, the liquid crystals deteriorate and their life becomes shortened, and the display quality consequently deteriorates. Thus, generally speaking, with a liquid crystal display unit, an alternate-current (AC) voltage drive of inverting the polarity of the voltage applied to the pixels for each frame is performed. In addition, for example, with a dot inversion-type AC voltage drive, the polarity of the voltage applied to the respective adjacent pixels of red (r), green (g), and blue (b) for each frame is inverted alternately for each pixel.

In a liquid crystal display unit to which this kind of AC voltage drive is performed, as shown in FIG. 19 for example, there are cases where a white image and a black image are alternately displayed for each frame. In the foregoing case, since the pixel voltage applied to the pixels relative to a common voltage Vcom becomes a DC voltage Vdc as an effective value, if this continues for a long period, the liquid crystals will deteriorate to thereby cause the display quality to deteriorate. For example, upon displaying an image on a liquid crystal display unit based on an interlaced signal, the alternate display of a white image and a black image tends to occur.

In order to prevent the pixel voltage from becoming the DC voltage Vdc as the effective value, as shown in FIG. 20 for example, a method of inverting the phase of the polarity of the voltage applied to the pixels for each of a plurality of frames is known. Consequently, the bias on the positive electrode side and the negative electrode side of the pixel voltage relative to the common voltage Vcom becomes inverted for each phase inversion. Accordingly, it is possible to inhibit the pixel voltage from becoming a DC voltage as the effective value.

However, as shown in FIG. 21 for example, when an image of substantially the same luminance is displayed, the luminance of the display image will increase in the frame immediately after the phase inversion, and thereby cause a flicker. As shown in FIG. 22 for example, when a phase inversion is not performed, a voltage having a different polarity will constantly be applied to the pixels for each frame. Meanwhile, when the phase of the polarity of the pixel voltage is inverted for each plurality of frames, as shown in FIG. 21, the voltage having the same polarity will be successively applied to the pixels in the frame immediately before the phase inversion and in the frame immediately after the phase inversion. When the voltage having the same polarity is successively applied to the pixels, the response of the liquid crystals will improve in comparison to the other frames. Thus, the luminance of the image in the frame immediately after the phase inversion will increase. Consequently, when performing phase inversion, while it is effective in preventing a DC voltage from being applied to the liquid crystals, there is a problem in that a flicker will occur as a side effect, and the display quality of images will deteriorate. Thus, the technology described in Japanese Patent Application Publication No. 2007-225861 proposes inhibiting the generation of flickers and preventing the deterioration in the display quality of images by lowering the voltage applied to the pixels in the frame immediately after the phase inversion.

However, the deterioration in the display quality of images caused by a flicker is affected by the temperature or variation in the liquid crystal display unit, and it is difficult to completely eliminate such deterioration. Moreover, while the deterioration in the display quality of images caused by a flicker is relatively difficult to detect in moving images such as those displayed on a TV, such deterioration becomes conspicuous in cases where there are many still images and the screen is uniform such as with the images displayed on a personal computer (PC). In recent years, cases of inputting these PC signals into a TV are increasing, and it is necessary to inhibit the generation of flickers and prevent the deterioration in the display quality of images. Meanwhile, since images displayed on PC screens and tablets were mainly based on progressive signals conventionally, this kind of phase inversion itself was not required. However, cases where interlaced signals are input via the internet are increasing. Thus, even with PC screens, it is necessary to prevent the deterioration in the display quality of images while preventing the generation of residual images caused by the application of a DC voltage to the pixels in an interlaced signal.

SUMMARY

In one general aspect, the instant application describes a liquid crystal display device that includes: a liquid crystal display unit that includes pixels and displays an image based on an input image signal input for each of frames; a drive unit that applies a voltage based on the input image signal to the pixels of the liquid crystal display unit while inverting a polarity of the voltage for each of the frames; a luminance determination unit that detects, for each of the frames, an average luminance of the image displayed on the liquid crystal display unit, and determines whether the detected average luminance has changed, between the frames adjacent to each other, by an amount equal to or more than a predetermined reference luminance; and a signal generation unit that generates a phase inversion enabling signal for inverting a phase of the polarity of the voltage applied to the pixels, in a case where the luminance determination unit determines that the average luminance has changed by the amount equal to or more than the reference luminance. The drive unit inverts the phase of the polarity of the voltage applied to the pixels when the phase inversion enabling signal is generated by the signal generation unit.

Since the phase of the polarity of the voltage applied to the pixels is inverted when the average luminance of the image is determined to have changed by an amount equal to or more than the reference luminance, the change in luminance caused by inverting the phase of the polarity of the voltage applied to the pixels will not be conspicuous and, therefore, it is possible to prevent the occurrence of residual images and prevent the deterioration in the display quality of images.

BRIEF DESCRIPTION OF THE DRAWINGS

FIG. 3 is a diagram showing, in tabular form, an operation example of the liquid crystal display device of the first embodiment;

FIG. 5 is a diagram showing, in tabular form, a setting example of a phase inversion enabling period by an enabling period setting circuit;

DESCRIPTION OF THE PREFERRED EMBODIMENTS

First Embodiment

Figure 1:
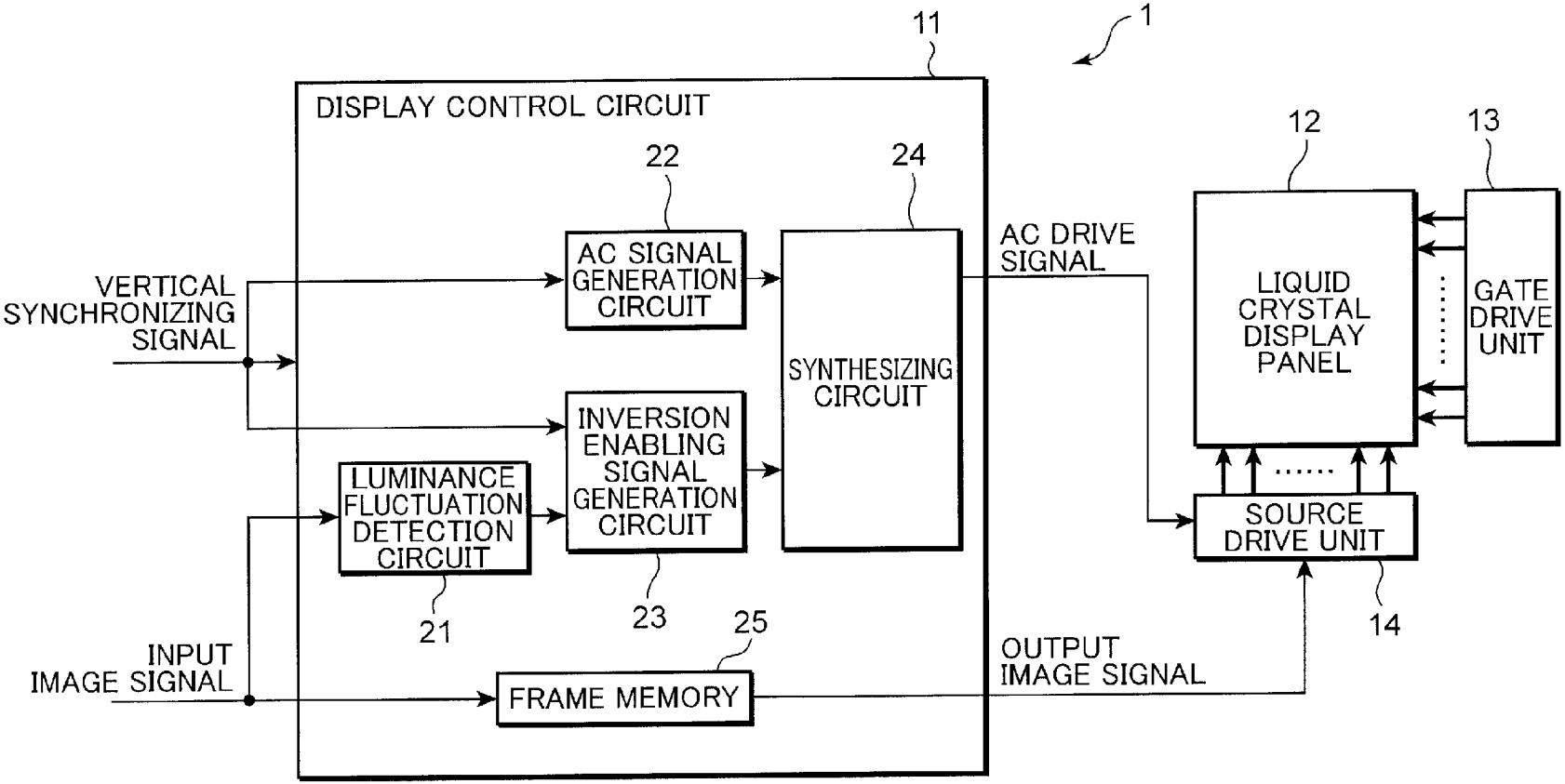
FIG. 1 is a block diagram showing a configuration of a liquid crystal display device according to a first embodiment of the instant application.
Figure 2:
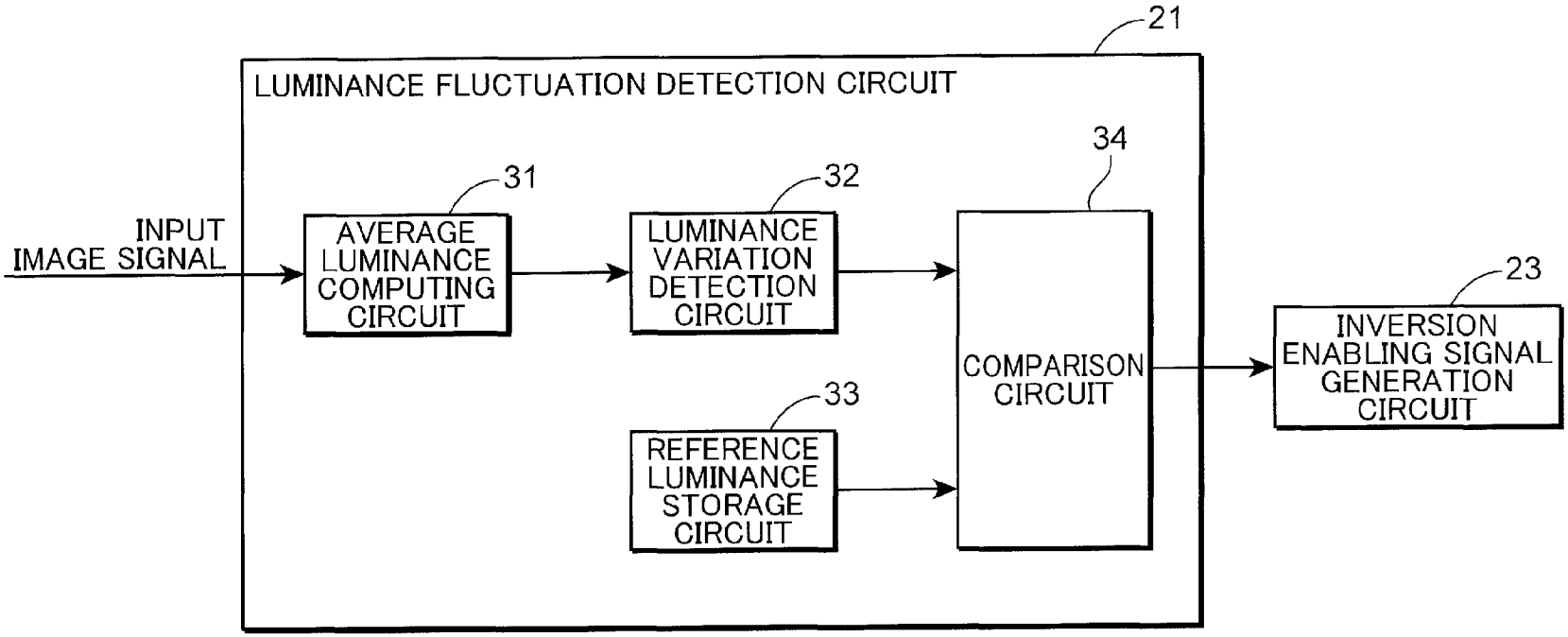
FIG. 2 is a block diagram showing a configuration of a luminance fluctuation detection circuit.

FIG. 1 is a block diagram showing a configuration of a liquid crystal display device according to a first embodiment of the instant application. FIG. 2 is a block diagram showing a configuration of a luminance fluctuation detection circuit. As shown in FIG. 1, the liquid crystal display device 1 comprises a display control circuit 11, a liquid crystal display panel 12, a gate drive unit 13, and a source drive unit 14.

The liquid crystal display panel 12 comprises the following components not shown; namely, a plurality of gate signal lines, a plurality of source signal lines and a plurality of pixels. The plurality of gate signal lines are respectively extending in a horizontal direction (main scanning direction), and provided in alignment in a vertical direction (sub scanning direction). The plurality of source signal lines are respectively extending in a vertical direction (sub scanning direction), and provided in alignment in a horizontal direction (main scanning direction). A plurality of pixels in a matrix are disposed at an intersection point of the plurality of gate signal lines and the plurality of source signal lines.

The display control circuit 11 controls the gate drive unit 13 and the source drive unit 14 based on the input image signals and the vertical synchronizing signals to write image data once per frame in the pixels, which are disposed in a matrix, of the liquid crystal display panel 12. The gate drive unit 13 applies a scan voltage to sequentially select the gate signal line from top to bottom. The source drive unit 14 applies a voltage corresponding to the image data via the source signal line to the respective pixels corresponding to the gate signal line that is being selected by the gate drive unit 13. Consequently, a voltage corresponding to the image data is applied to the liquid crystal layer of the respective pixels, and the transmittance of the respective pixels is thereby controlled. As a result of the selection of the gate signal line from top to bottom being completed by the gate drive unit 13, image data is written in all pixels once based on input image signals and the vertical synchronizing signal. An image of one frame is generated by the image data being written in all pixels. The liquid crystal display panel 12 is a hold-type display unit which holds the written image data for one frame period up to the writing of the subsequent image data.

As a result of the image generation of one frame being repeated at a predetermined frame frequency by the display control circuit 11, the image displayed on the liquid crystal display panel 12 can be visually recognized by the viewer. Note that, as the liquid crystal display panel 12, the in plane switching (IPS) system, vertical alignment (VA) system, or other systems may be applied.

The display control circuit 11 includes, as shown in FIG. 1, a luminance fluctuation detection circuit 21, an alternate-current (AC) signal generation circuit 22, an inversion enabling signal generation circuit 23, a synthesizing circuit 24 and a frame memory 25. The luminance fluctuation detection circuit 21 detects the fluctuation range of luminance of the input image signal between adjacent frames. As shown in FIG. 2, the luminance fluctuation detection circuit 21 includes an average luminance computing circuit 31, a luminance variation detection circuit 32, a reference luminance storage circuit 33, and a comparison circuit 34.

The average luminance computing circuit 31 calculates the average value of luminance of the display image in one frame based on the input image signal. The average luminance computing circuit 31 may integrate the luminance values of all pixels to obtain the average value. Moreover, the average luminance computing circuit 31 may also integrate the luminance values of certain pixels extracted among all pixels to obtain the average value.

The luminance variation detection circuit 32 detects the variation in the average value of the luminance calculated by the average luminance computing circuit 31. The luminance variation detection circuit 32 obtains, for example, the difference value of the luminance average value of the current frame and the luminance average value of the previous frame that is displayed in the preceding frame. In other words, the luminance variation detection circuit 32 retains the average value of the luminance calculated by the average luminance computing circuit 31 just for one frame period, and obtains the difference value of the luminance average values between the adjacent frames. Alternatively, the luminance variation detection circuit 32 may also retain the average values of the luminance calculated by the average luminance computing circuit 31 for a plurality of frames (for instance, four frames) before the current frame, and obtain the difference value between the average of the luminance average values of the plurality of frames and the luminance average value of the current frame.

The reference luminance storage circuit 33 stores a predetermined reference luminance. The reference luminance is set by adding a predetermined width to the luminance level in which a flicker is visually recognized when the luminance increases due to a phase inversion. For example, in a case where the luminance level is represented in 8 bits (0 to 255), in this embodiment, for example, if a flicker is visually recognized when the variation in luminance is a luminance level of "5" or lower, the reference luminance of "8" obtained by adding the predetermined width of "3" is stored as the predetermined reference luminance in the reference luminance storage circuit 33.

The comparison circuit 34 compares the difference value output from the luminance variation detection circuit 32 and the reference luminance stored in the reference luminance storage circuit 33. When the difference value output from the luminance variation detection circuit 32 is greater than the reference luminance stored in the reference luminance storage circuit 33, the comparison circuit 34 outputs, for example, a high level signal to the inversion enabling signal generation circuit 23, and, when the foregoing difference value is not greater than the foregoing reference luminance, outputs a low level signal to the inversion enabling signal generation circuit 23. In other words, the comparison circuit 34 outputs, to the inversion enabling signal generation circuit 23, a signal capable of differentiating the magnitude relationship of the foregoing difference value and the foregoing reference luminance.

In FIG. 1, the AC signal generation circuit 22 outputs an AC signal which causes the polarity of the applied voltage to become inverted for each frame in order to drive, via an AC voltage, the pixels of the liquid crystal display panel 12. When the foregoing high level signal is output from the comparison circuit 34 of the luminance fluctuation detection circuit 21, the inversion enabling signal generation circuit 23 outputs a phase inversion enabling signal for inverting the phase of the polarity inversion of the voltage applied to the pixels. The synthesizing circuit 24 generates an AC drive signal by synthesizing the AC signal output from the AC signal generation circuit 22 and the phase inversion enabling signal output from the inversion enabling signal generation circuit 23, and outputs the generated AC drive signal to the source drive unit 14. In other words, when the phase inversion enabling signal is output from the inversion enabling signal generation circuit 23, the synthesizing circuit 24 inverts the phase of the polarity of the generated AC drive signal.

The frame memory 25 delays the input image signal by one frame period. The display control circuit 11 generates an output image signal from the input image signal that was delayed by one frame period by the frame memory 25 based on a vertical synchronizing signal, and outputs the generated output image signal to the source drive unit 14. In this embodiment, the liquid crystal display panel 12 corresponds to an example of the liquid crystal display unit, the source drive unit 14 corresponds to an example of the drive unit, the luminance fluctuation detection circuit 21 corresponds to an example of the luminance determination unit, and the inversion enabling signal generation circuit 23 corresponds to an example of the signal generation unit.

FIG. 3 is a diagram showing, in tabular form, the operation example of the liquid crystal display device 1 of the first embodiment. In the operation example shown in FIG. 3, the luminance average value calculated by the average luminance computing circuit 31 is 50 for frames F1 to F4, and 60 for frames F5 to F8. In other words, while the luminance average value was 50 up to the frame F4, the luminance average increased by a luminance level of "10" to 60 in the frame F5. Accordingly, in this embodiment, for example, since the reference luminance=8, the level of the signal output from the comparison circuit 34 is a low level in the frames F1 to F4, F6 to F8, and is a high level in the frame F5. Consequently, in the frame F5, the phase inversion enabling signal is output from the inversion enabling signal generation circuit 23.

Meanwhile, as described above, the input image signal is delayed one frame period by the frame memory 25, and the output image signal is generated by the display control circuit 11. Accordingly, as shown in FIG. 3, while the luminance average value of the output image signal was 50 up to the frame F5 as a result of being delayed one frame relative to the luminance average value calculated by the average luminance computing circuit 31, the luminance average value increases to 60 in the frame F6. Consequently, in the frame F6, the increase timing of the luminance average value and the phase inversion timing will coincide. Consequently, in the frame F6, the change in luminance caused by the phase inversion will not be conspicuous.

As described above, in this first embodiment, when the variation in the luminance average value of the input image signal is greater than the reference luminance, the phase inversion enabling signal is output and the phase of the polarity of the AC drive signal is inverted. Accordingly, since the variation in the luminance average value of the input image signal is greater than the reference luminance, the change in luminance caused by the phase inversion of the AC drive signal will not be conspicuous. Consequently, it is possible to prevent the generation of residual images while preventing the deterioration in the display quality of images.

Note that, in the foregoing first embodiment, the inversion enabling signal generation circuit 23 may also count, based on the vertical synchronizing signal, the elapsed time from the time that the phase inversion enabling signal was generated, and coercively generate a phase inversion enabling signal when the subsequent phase inversion enabling signal is not generated even after the lapse of a predetermined time, and output such generated phase inversion enabling signal to the synthesizing circuit 24. According to this modified embodiment, it is possible to reliably invert the phase of the polarity of the voltage applied to the pixels before exceeding a predetermined time from the previous phase inversion operation. Consequently, it is possible to reliably prevent the generation of residual images. In this modified embodiment, the foregoing predetermined time corresponds to an example of the second period.

Second Embodiment

Figure 4:
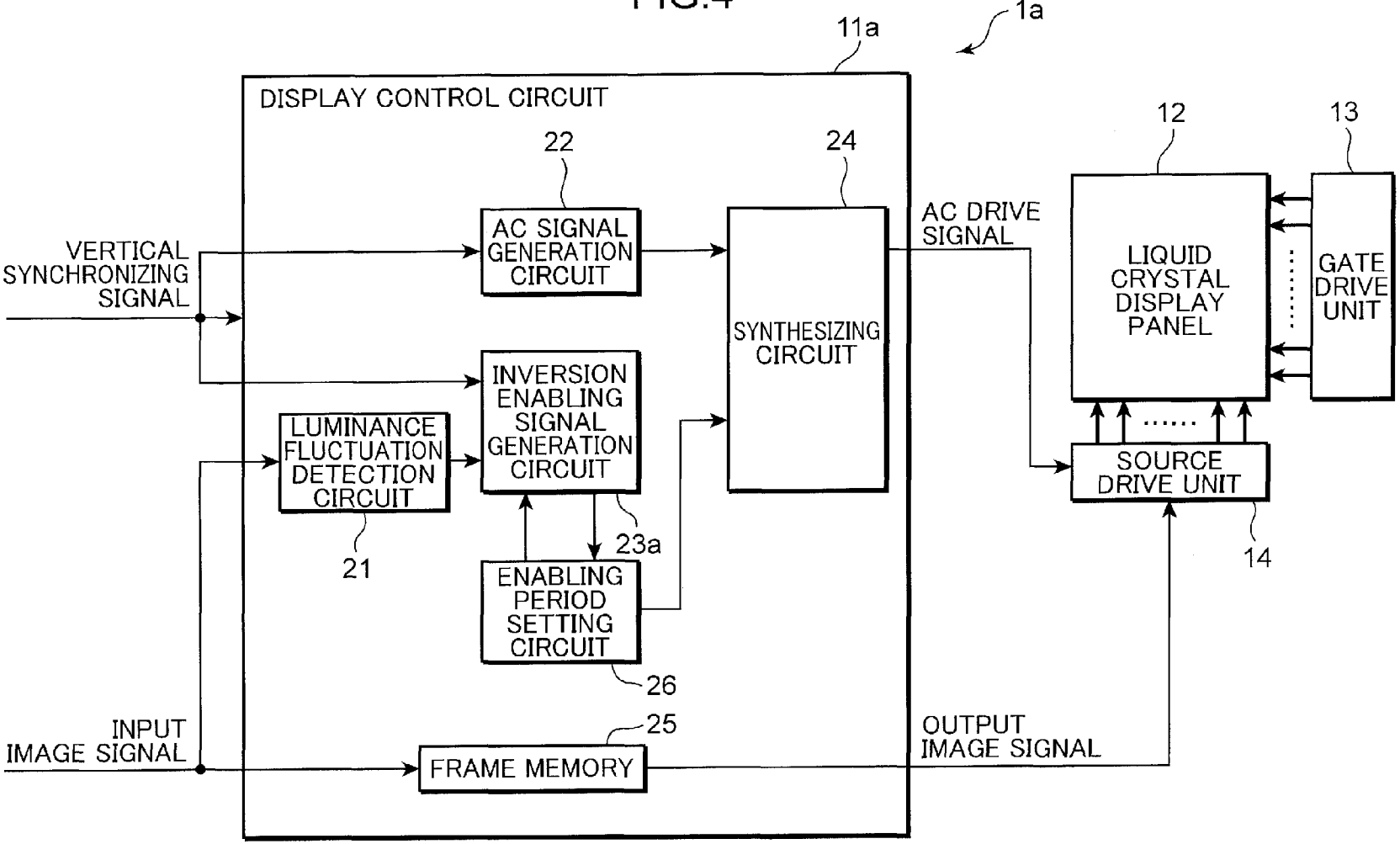
FIG. 4 is a block diagram showing a configuration of a liquid crystal display device according to a second embodiment of the instant application.

FIG. 4 is a block diagram showing a configuration of a liquid crystal display device 1*a* according to a second embodiment of the instant application. In the second embodiment, the same reference numeral is given to the same element as the first embodiment, and the second embodiment is now described mainly around the differences with the first embodiment.

The liquid crystal display device 1*a* of the second embodiment shown in FIG. 4 comprises a display control circuit 11*a*, in substitute for the display control circuit 11, in the liquid crystal display device 1 of the first embodiment shown in FIG. 1. The display control circuit 11*a* additionally comprises an enabling period setting circuit 26, and additionally comprises an inversion enabling signal generation circuit 23*a* in substitute for the inversion enabling signal generation circuit 23 in the display control circuit 11 shown in FIG. 1.

When the high level signal is output from the comparison circuit 34 (FIG. 2) of the luminance fluctuation detection circuit 21, the inversion enabling signal generation circuit 23*a* outputs the phase inversion enabling signal to the enabling period setting circuit 26. The enabling period setting circuit 26 sets a phase inversion enabling period as a period of enabling the phase inversion of the polarity in the AC drive signal. A setting example of the phase inversion enabling period by the enabling period setting circuit 26 will be described later. Moreover, when the phase inversion enabling signal is output from the inversion enabling signal generation circuit 23*a* during the set phase inversion enabling period, the enabling period setting circuit 26 outputs, to the synthesizing circuit 24, the phase inversion enabling signal that was output from the inversion enabling signal generation circuit 23*a*. Moreover, the enabling period setting circuit 26 notifies information related to the set phase inversion enabling period to the inversion enabling signal generation circuit 23*a*. Moreover, when the phase inversion enabling signal is output from the inversion enabling signal generation circuit 23*a* during the set phase inversion enabling period, the enabling period setting circuit 26 ends the set phase inversion enabling period.

The inversion enabling signal generation circuit 23*a* coercively generates the phase inversion enabling signal and outputs the generated phase inversion enabling signal to the enabling period setting circuit 26, when a high level signal is not output from the comparison circuit 34 (FIG. 2) of the luminance fluctuation detection circuit 21 and a phase inversion enabling signal has not been output by the frame immediately before the end of the phase inversion enabling period notified by the enabling period setting circuit 26. When a phase inversion enabling signal is output from the inversion enabling signal generation circuit 23*a* before the end of the phase inversion enabling period, the enabling period setting circuit 26 outputs the phase inversion enabling signal to the synthesizing circuit 24. In this embodiment, the liquid crystal display panel 12 corresponds to an example of the liquid crystal display unit, the source drive unit 14 corresponds to an example of the drive unit, the luminance fluctuation detection circuit 21 corresponds to an example of the luminance determination unit, the inversion enabling signal generation circuit 23*a* corresponds to an example of the signal generation unit, and the enabling period setting circuit 26 corresponds to an example of the setting unit.

Figure 6:
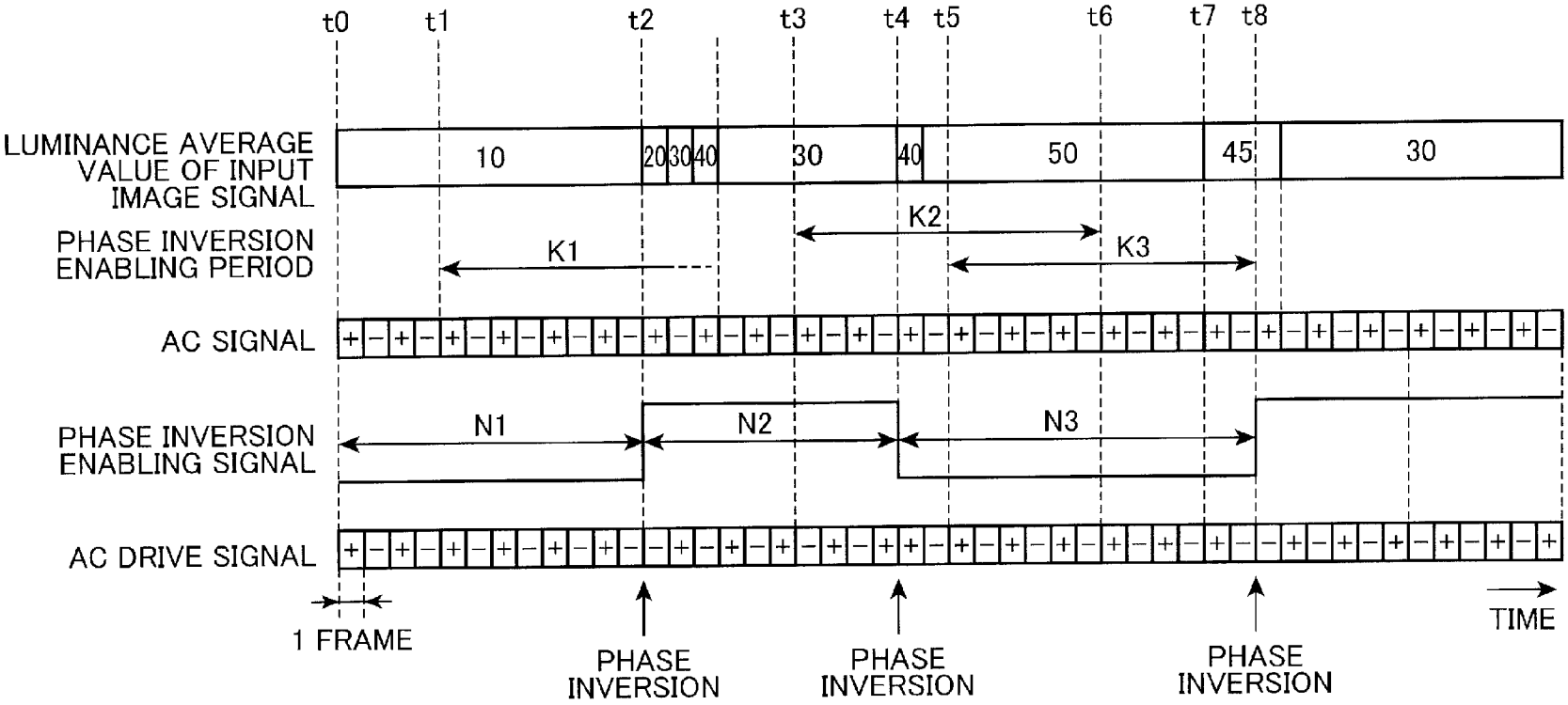
FIG. 6 is a timing chart schematically showing an operation example of the liquid crystal display device of the first embodiment.

FIG. 5 is a diagram showing, in tabular form, the setting example of the phase inversion enabling period by the enabling period setting circuit 26. FIG. 6 is a timing chart schematically showing the operation example of the liquid crystal display device 1*a* of the second embodiment.

In FIG. 5, the polarity of the positive and negative is shown to indicate the phase inversion state. In other words, "−" is shown as the polarity indicating the first phase inversion state, "+" is shown as the polarity indicating the second phase inversion state, "−" is shown as the polarity indicating the third phase inversion state, and "+" is shown as the polarity indicating the fourth phase inversion state. Moreover, in the example shown in FIG. 5, the enabling period setting circuit 26 has set the first phase inversion enabling period to 5th frame to 50th frame.

In FIG. 6, the operation of the liquid crystal display device 1*a* is started at time t0, and an input image signal having a luminance average value of "10" is input in the 1st frame to the 12th frame. Since the luminance average value does not change, the inversion enabling signal generation circuit 23 does not output a phase inversion enabling signal. The AC signal generation circuit 22 outputs an AC signal in which the polarity of the applied voltage is inverted for each frame. Thus, the synthesizing circuit 24 directly outputs the AC signal, which is output from the AC signal generation circuit 22, as the AC drive signal to the source drive unit 14. The source drive unit 14 inverts and drives, based on the AC drive signal, the polarity of the voltage applied to the respective pixels of the liquid crystal display panel 12 for each frame.

As described above, the first phase inversion enabling period is set as the 5th frame to 50th frame. Accordingly, the first phase inversion enabling period K1 is started from time t1 of the 5th frame. In the 13th frame, the luminance average value of the input image signal is increased, by a luminance level of "10", to become "20". Accordingly, at time t2, a high level signal is output from the comparison circuit 34, as a result of which the inversion enabling signal generation circuit 23*a* outputs a phase inversion enabling signal to the enabling period setting circuit 26. In this second embodiment, the phase inversion enabling signal is a signal in which the signal level is inverted between the low level signal and the high level signal as shown in FIG. 6.

When a phase inversion enabling signal is output from the inversion enabling signal generation circuit 23*a* at time t2, since this is in the phase inversion enabling period, the enabling period setting circuit 26 outputs the phase inversion enabling signal, which was output from the inversion enabling signal generation circuit 23*a*, to the synthesizing circuit 24. The synthesizing circuit 24 outputs, as the AC drive signal, a signal which results from inverting the AC signal output from the AC signal generation circuit 22. Consequently, at time t2, the phase of the polarity of the AC drive signal is inverted. In other words, while the polarity of the AC drive signal in the 12 frames of time t0 to time t2 is "+", "−", . . . , "+", "−", the polarity of the AC drive signal from time t2 is "−", "+", . . . . While not shown in FIG. 6 for the sake of convenience in the illustration of diagrams, the first phase inversion enabling period K1 ends at time t2 when the phase inversion was performed. As described above, the state of the polarity of the AC drive signal is inverted from "+", "−", . . . , to "−", "+", . . . . This inversion from"+", "−", . . . , to "−", "+", . . . , is called "the phase of the polarity of the AC drive signal is inverted", or the "phase inversion" in this specification.

Since the phase of the AC drive signal is inverted at time t2, the actual phase inversion cycle N1=12 frames. As shown in FIG. 5, since this is the first phase inversion cycle, the cycle excess and deficiency is equal to 0 frame. Thus, the enabling period setting circuit 26 sets the target value of the subsequent phase inversion to 12 frames, which is the same as the present phase inversion cycle N1. Moreover, as shown in FIG. 5, the enabling period setting circuit 26 sets the second phase inversion enabling period to 12±6 frames. In other words, the enabling period setting circuit 26 sets, as the phase inversion enabling period, a period in which a predetermined width (in this embodiment, for example, 6 frames) is provided before and after the target value of phase inversion. Accordingly, as shown in FIG. 6, time t5, which is the 12th frame from time t2, is the second target value, and the period from time t3 to time t6, which is a period of 6 frames before and after the second target value, is the second phase inversion enabling period K2.

Meanwhile, the luminance average value of the input image signal increases to "20" at time t2, and thereafter increases to "30", "40" for each frame. Consequently, since just a luminance level of "10", which is greater than the reference luminance=8, has increased, a high level signal is output from the comparison circuit 34, and a phase inversion enabling signal is output from the inversion enabling signal generation circuit 23*a*. However, since it is not in the phase inversion enabling period, the enabling period setting circuit 26 does not output the phase inversion enabling signal, which was output from the inversion enabling signal generation circuit 23*a*, to the synthesizing circuit 24.

In addition, the luminance average value of the input image signal decreases to "30" in the subsequent frame, and thereafter the state of "30" continues for a period of 7 frames. Subsequently, at time t4 of the 8th frame, the luminance average value of the input image signal increases from "30" to "40". Consequently, since an increase is exhibited just by a luminance level of "10", which is greater than the reference luminance=8, a high level signal is output from the comparison circuit 34 at time t4, and a phase inversion enabling signal is output from the inversion enabling signal generation circuit 23*a*.

When a phase inversion enabling signal is output from the inversion enabling signal generation circuit 23*a* at time t4, since it is in the phase inversion enabling period, the enabling period setting circuit 26 outputs the phase inversion enabling signal, which was output from the inversion enabling signal generation circuit 23*a*, to the synthesizing circuit 24. The synthesizing circuit 24 directly outputs the AC signal, which was output from the AC signal generation circuit 22, as the AC drive signal. Consequently, at time t4, the phase of the polarity of the AC drive signal is inverted. In other words, while the polarity of the AC drive signal in the frames from time t2 to time t4 is "−", "+", . . . , "−", "+", the polarity of the AC drive signal from time t4 is "+", "−", . . . . While not shown in FIG. 6 for the sake of convenience in the illustration of diagrams, the second phase inversion enabling period K2 ends at time t4 when the phase inversion was performed.

Since the phase of the AC drive signal is inverted at time t4, the actual second phase inversion cycle N2=10 frames. As shown in FIG. 5, since the target value of the second phase inversion cycle was 12 frames, the cycle excess and deficiency will be −2 frames. Thus, the enabling period setting circuit 26 sets the target value of the subsequent phase inversion to 8 frames, which is 2 frames less than the present phase inversion cycle N2. Thus, as shown in FIG. 5, the enabling period setting circuit 26 sets the third phase inversion enabling period to 8±6 frames. Accordingly, as shown in FIG. 6, time t6, which is the 8th frame from time t4, is the third target value, and the period from time t5 to time t8, which is a period of 6 frames before and after the third target value, is the third phase inversion enabling period K3.

Meanwhile, the luminance average value of the input image signal increases to "40" at time t4, and thereafter increases to "50" in the subsequent frame. Consequently, since an increase is exhibited just by a luminance level of "10", which is greater than the reference luminance=8, a high level signal is output from the comparison circuit 34, and a phase inversion enabling signal is output from the inversion enabling signal generation circuit 23*a*. Nevertheless, since it is not in the phase inversion enabling period, the enabling period setting circuit 26 does not output the phase inversion enabling signal, which was output from the inversion enabling signal generation circuit 23*a*, to the synthesizing circuit 24.

The luminance average value of the input image signal continues a state of "50", decreases to "45" at time t7, and thereafter the state of "45" continues for a period of 3 frames. Accordingly, at time t8, the third phase inversion enabling period K3 is ended. The inversion enabling signal generation circuit 23*a* coercively generates a phase inversion enabling signal and outputs the generated phase inversion enabling signal to the enabling period setting circuit 26, since a high level signal was not output from the comparison circuit 34, and consequently, a phase inversion enabling signal was not generated, by the frame immediately before the end of the phase inversion enabling period K3 notified by the enabling period setting circuit 26. The enabling period setting circuit 26 outputs, to the synthesizing circuit 24, the phase inversion enabling signal that was output from the inversion enabling signal generation circuit 23*a* before the end of the phase inversion enabling period K3.

The synthesizing circuit 24 inverts the AC signal output from the AC signal generation circuit 22 and outputs the inverted AC signal as the AC drive signal. Consequently, at time t8, the phase of the polarity of the AC drive signal is inverted. In other words, while the polarity of the AC drive signal in the frames from time t4 to time t8 is "+", "−", . . . , "+", "−", the polarity of the AC drive signal from time t8 is "−", "+", . . . .

Since the phase of the AC drive signal is inverted at time t8, the actual third phase inversion cycle N3=14 frames. As shown in FIG. 5, since the target value of the third phase inversion cycle was 8 frames, the cycle excess and deficiency will be +6 frames. Thus, the enabling period setting circuit 26 sets the target value of the subsequent phase inversion to 20 frames, which is 6 frames more than the present phase inversion cycle N3. Thus, as shown in FIG. 5, the enabling period setting circuit 26 sets the fourth phase inversion enabling period to 20±6 frames.

As described above, in this second embodiment, when the phase inversion enabling period is set by the enabling period setting circuit 26 and a phase inversion enabling signal is output in the set phase inversion enabling period, the phase of the AC drive signal is inverted. Thus, according to the second embodiment, it is possible to adjust the phase inversion cycle, while avoiding the implementation of the phase inversion of the AC drive signal, each time the variation in the luminance average value of the input image signal exceeds the reference luminance.

Moreover, in the second embodiment, the target value of the subsequent phase inversion is set based on the actual phase inversion cycle and the excess and deficiency of the cycle relative to the target value of phase inversion. Accordingly, it is possible to adjust the phase inversion cycle in which the polarity indicating the phase inversion state is "−" and the phase inversion cycle in which the polarity indicating the phase inversion state is "+" so that they become equal cycles from a long-term perspective. Consequently, it is possible to prevent the generation of residual images caused by the phase inversion cycles of the polarities being "+" and "−" not being equal. For example, when one cycle of either the phase inversion cycle, in which the polarity indicating the phase inversion state is "−" or the phase inversion cycle in which the polarity indicating the phase inversion state is "+", becomes longer than the other cycle, a DC voltage, as the effective value of the AC drive signal, will be applied to the pixels. Thus, when the phase inversion cycles are not equal, this causes the generation of residual images. Meanwhile, in this second embodiment, since the phase inversion cycles are caused to be equal, it is possible to eliminate the cause that generates residual images.

Moreover, in the second embodiment, the inversion enabling signal generation circuit 23*a* coercively generates a phase inversion enabling signal and outputs the generated phase inversion enabling signal to the enabling period setting circuit 26, when a high level signal was not output from the comparison circuit 34, and consequently, a phase inversion enabling signal was not generated, by the frame immediately before the end of the phase inversion enabling period notified by the enabling period setting circuit 26. Accordingly, it is possible to reliably invert the phase of the polarity of the voltage applied to the pixels by the time the phase inversion enabling period exceeds. Consequently, it is possible to reliably prevent the generation of residual images. In this second embodiment, the third phase inversion cycle N3 corresponds to an example of the second period.

Note that, in the foregoing second embodiment, as shown in FIG. 5, the phase inversion enabling period is set to the target value of ±6 frames. In other words, in the phase inversion enabling period, the duration before and after the target value; that is, the width of the "−" side and the width of the "+" side relative to the target value are set as the same value. Nevertheless, the present implementation is not limited thereto, and different values may be set.

Figure 7:
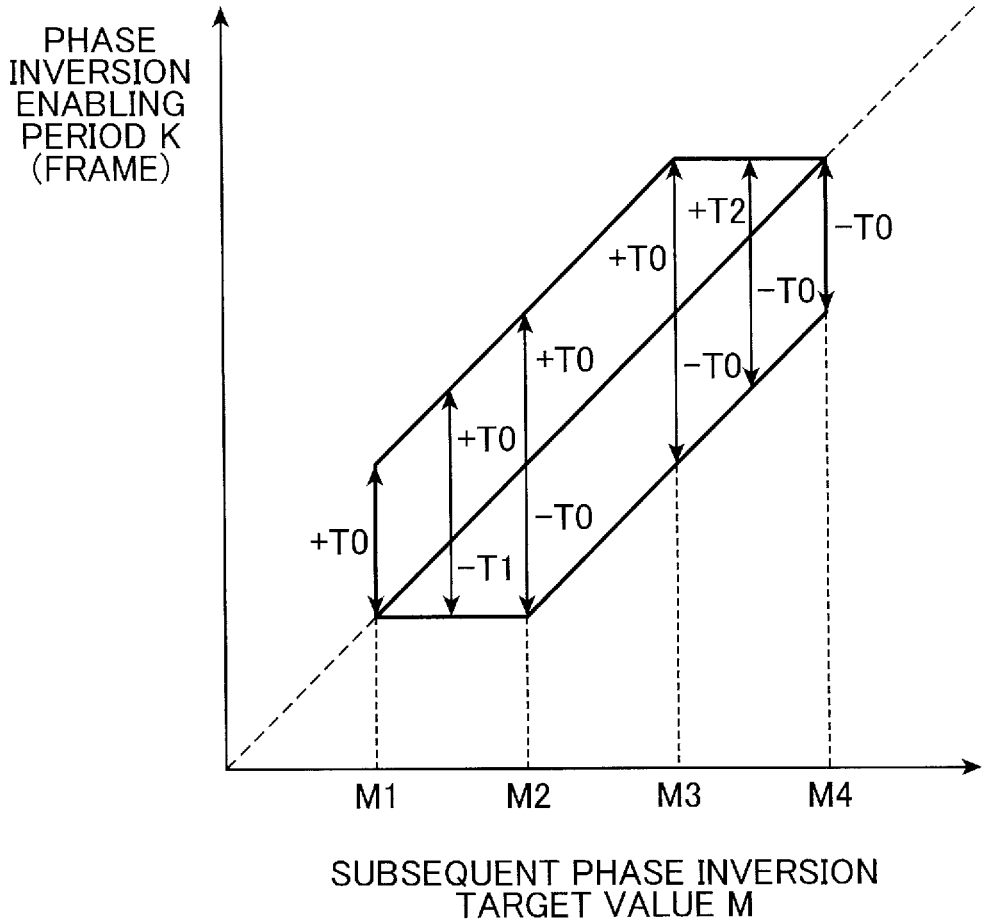
FIG. 7 is a diagram schematically showing an example where the enabling period setting circuit sets the before-and-after duration, which is to be provided to the target value of phase inversion, as different values.

FIG. 7 is a diagram schematically showing an example where the enabling period setting circuit 26 sets the before-and-after duration, which is to be provided to the target value of phase inversion, as different values on the "−" side and the "+" side. FIG. 7 shows the phase inversion enabling period K relative to the subsequent phase inversion target values M1 to M4; provided, however, that M1<M2<M3<M4.

The phase inversion enabling period K relative to the phase inversion target value M1, which is the minimum value, is set to K=M1+T0. The subsequent phase inversion target value M is set to K=M+T0−T1 in the range of M1<M<M2; provided, however, that T0>T1. The subsequent phase inversion target value M is set to K=M±T0 in the range of M2≤M≤M3. In other words, as with the foregoing second embodiment, width of the "−" side and the width of the "+" side relative to the target value are set as the same value. The subsequent phase inversion target value M is set to K=M+T2−T0 in the range of M3<M<M4; provided, however, that T0>T2. The phase inversion enabling period K relative to the phase inversion target value M4, which is the maximum value, is set to K=M4−T0.

As described above, in the example shown in FIG. 7, when the target value M is small, the width of the "+" side is increased so that the target value M will not become any smaller. Meanwhile, when the target value M is large, the width of the "−" side is increased so that the target value M will not become any larger. Consequently, the phase inversion enabling period K can be appropriately set in accordance with the size of the target value M.

Moreover, in the foregoing second embodiment, while the enabling period setting circuit 26 sets the subsequent phase inversion enabling period each time a phase inversion enabling signal is generated and the phase inversion is performed, the present implementation is not limited thereto. Alternatively, the enabling period setting circuit 26 may also set a pre-fixed phase inversion enabling period.

Third Embodiment

Figure 8:
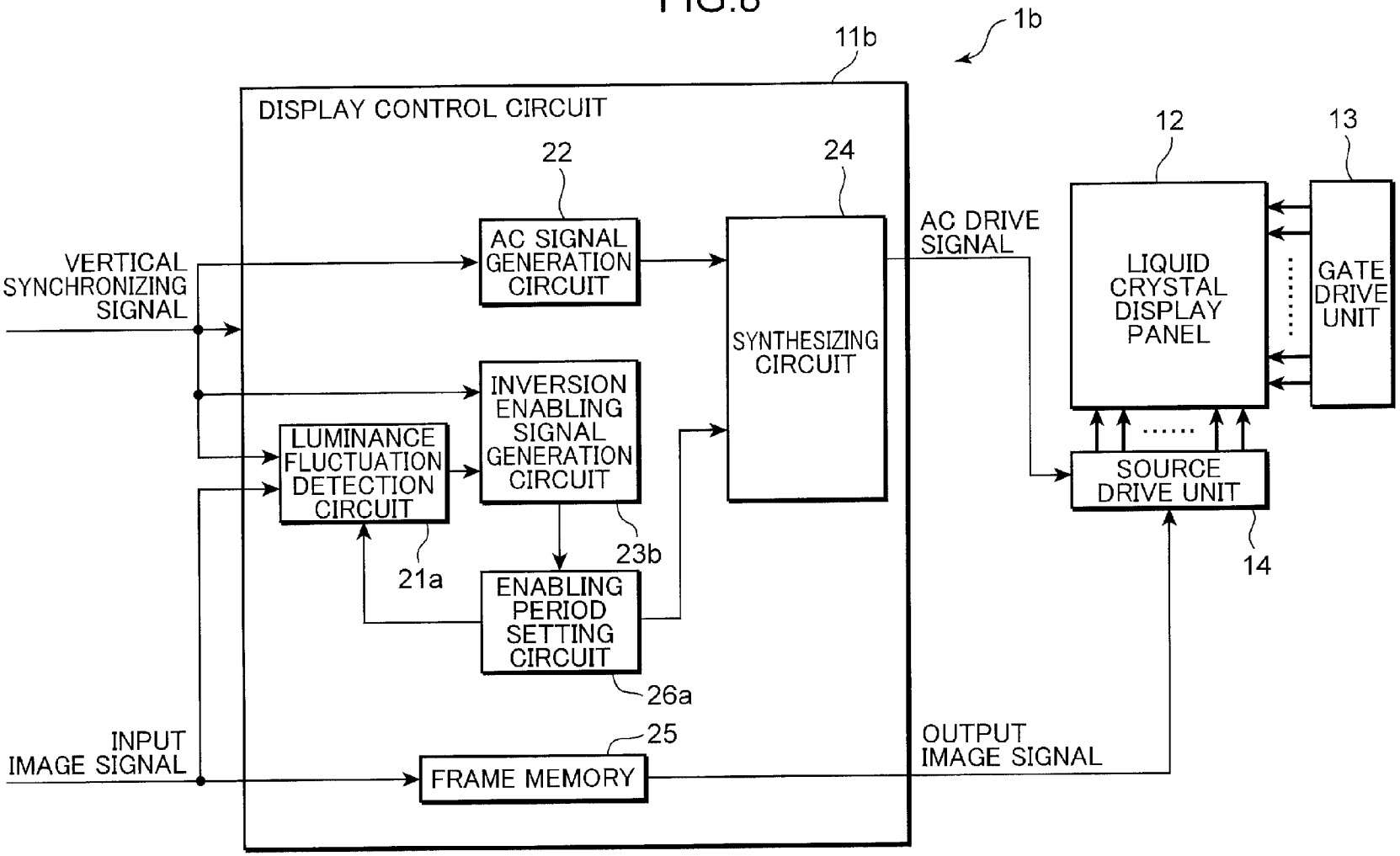
FIG. 8 is a block diagram showing a configuration of a liquid crystal display device according to a third embodiment of the instant application.
Figure 9:
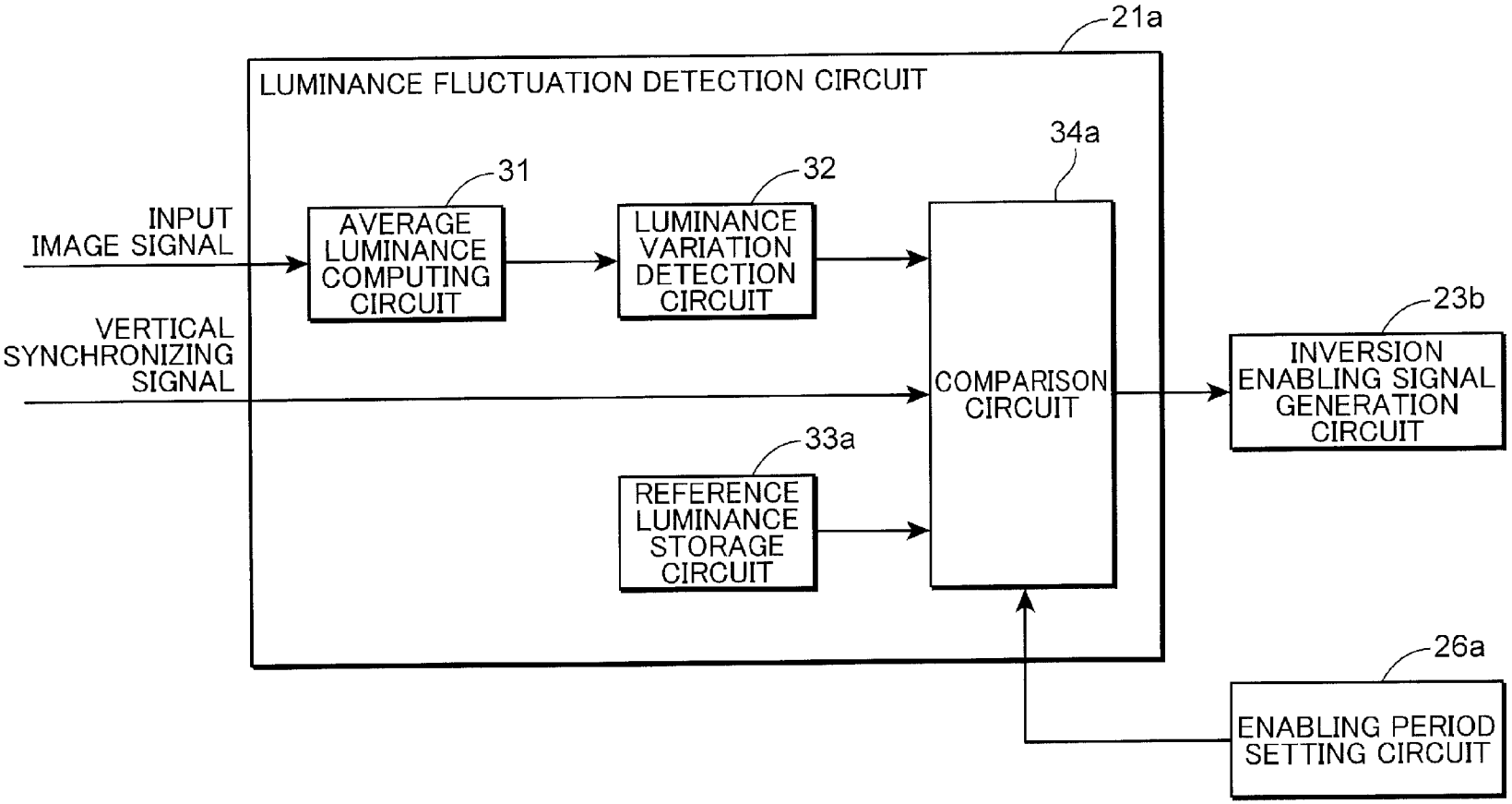
FIG. 9 is a block diagram showing a configuration of a luminance fluctuation detection circuit.
Figure 10:
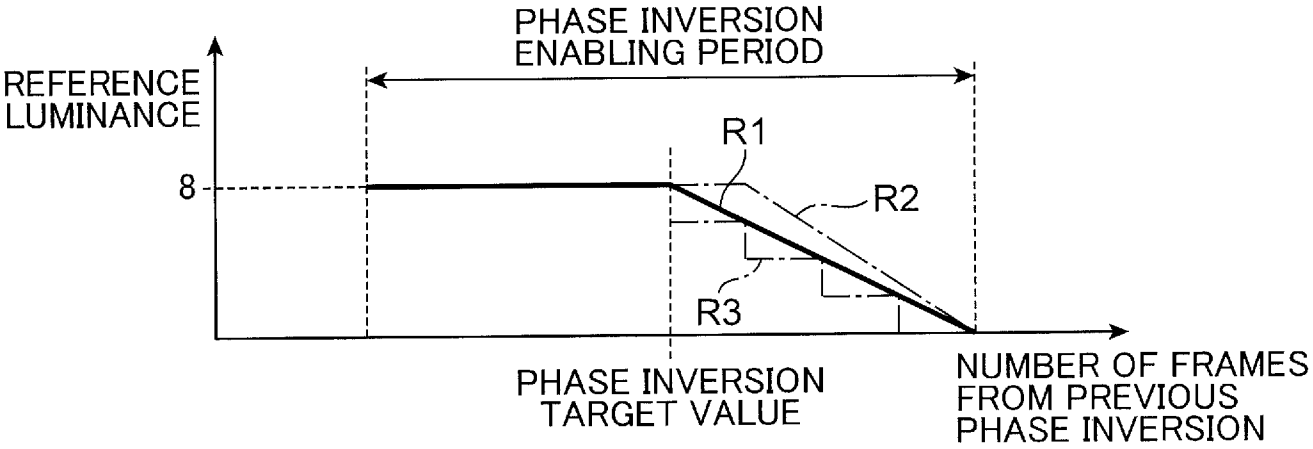
FIG. 10 is a diagram schematically showing a reference luminance stored in a reference luminance storage circuit.

FIG. 8 is a block diagram showing a configuration of a liquid crystal display device 1*b* according to a third embodiment of the instant application. FIG. 9 is a block diagram showing a configuration of a luminance fluctuation detection circuit 21*a*. FIG. 10 is a diagram schematically showing a reference luminance stored in a reference luminance storage circuit 33*a*. In the third embodiment, the same reference numeral is given to the same element as the first and second embodiments, and the third embodiment is now described mainly around the differences with the first and second embodiments.

The liquid crystal display device 1*b* of the third embodiment shown in FIG. 8 comprises a display control circuit 11*b*, in substitute for the display control circuit 11, in the liquid crystal display device 1 of the first embodiment shown in FIG. 1. The display control circuit 11*b* additionally comprises an enabling period setting circuit 26*a*, further comprises a luminance fluctuation detection circuit 21*a* in substitute for the luminance fluctuation detection circuit 21, and further comprises an inversion enabling signal generation circuit 23*b* in substitute for the inversion enabling signal generation circuit 23 in the display control circuit 11 shown in FIG. 1. The luminance fluctuation detection circuit 21*a* shown in FIG. 9 comprises, in the luminance fluctuation detection circuit 21 shown in FIG. 2, a reference luminance storage circuit 33*a* in substitute for the reference luminance storage circuit 33, and a comparison circuit 34*a* in substitute for the comparison circuit 34.

The inversion enabling signal generation circuit 23*b* outputs a phase inversion enabling signal to the enabling period setting circuit 26*a* when the comparison circuit 34*a* of the luminance fluctuation detection circuit 21*a* outputs a high level signal as described later. As with the enabling period setting circuit 26 of the second embodiment, the enabling period setting circuit 26*a* sets the phase inversion enabling period as a period of enabling the phase inversion of the polarity in the AC drive signal. Moreover, when the phase inversion enabling signal is output from the inversion enabling signal generation circuit 23*b* during the set phase inversion enabling period, the enabling period setting circuit 26*a* outputs, to the synthesizing circuit 24, the phase inversion enabling signal that was output from the inversion enabling signal generation circuit 23*b*. Moreover, the enabling period setting circuit 26*a* notifies information related to the set phase inversion enabling period to the comparison circuit 34*a* of the luminance fluctuation detection circuit 21*a*.

The reference luminance storage circuit 33 of the first embodiment stores a reference luminance of a constant value. Meanwhile, the reference luminance storage circuit 33*a* of the third embodiment stores, as shown in FIG. 10, a reference luminance in which the value changes in the phase inversion enabling period. In other words, a reference luminance line R1 stored in the reference luminance storage circuit 33*a* is set to a certain value (for example, set to 8, which is the same as in the first embodiment) from the start of the phase inversion enabling period up to the target value of phase inversion, and, upon exceeding the target value, decreases linearly and is set to 0 at the end of the phase inversion enabling period.

The comparison circuit 34*a* obtains an elapsed time in the phase inversion enabling period based on the phase inversion enabling period notified by the enabling period setting circuit 26*a* and the vertical synchronizing signal, extracts the reference luminance corresponding to the obtained elapsed time from the reference luminance line R1 stored in the reference luminance storage circuit 33*a*, and compares the extracted reference luminance and the difference value output from the luminance variation detection circuit 32. As with the comparison circuit 34 of the first embodiment, the comparison circuit 34*a* outputs, for example, a high level signal to the inversion enabling signal generation circuit 23*b* when the difference value output from the luminance variation detection circuit 32 is greater than the reference luminance extracted from the reference luminance line R1 stored in the reference luminance storage circuit 33*a*, and outputs a low level signal to the inversion enabling signal generation circuit 23*b* when the foregoing difference value is not greater than the foregoing reference luminance. In other words, as with the comparison circuit 34 of the first embodiment, the comparison circuit 34*a* outputs, to the inversion enabling signal generation circuit 23*b*, a signal capable of differentiating the magnitude relationship of the foregoing difference value and the foregoing reference luminance. In this embodiment, the liquid crystal display panel 12 corresponds to an example of the liquid crystal display unit, the source drive unit 14 corresponds to an example of the drive unit, the luminance fluctuation detection circuit 21*a* corresponds to an example of the luminance determination unit, the inversion enabling signal generation circuit 23*b* corresponds to an example of the signal generation unit, and the enabling period setting circuit 26*a* corresponds to an example of the setting unit. Moreover, in this embodiment, the comparison circuit 34*a* corresponds to an example of the first reference changing unit, and the period from the previous phase inversion to the target value of phase inversion corresponds to an example of the first period.

As described above, in this third embodiment, since a reference luminance line R1, in which the reference luminance decreases from the target value of phase inversion, is used, it is likely that a phase inversion enabling signal will be output by the end of the phase inversion enabling period. Accordingly, it is possible to prevent the phase inversion enabling period from lapsing without a phase inversion enabling signal being output and, consequently, it is possible to more reliably prevent the generation of residual images.

Note that the reference luminance stored in the reference luminance storage circuit 33*a* is not limited to the reference luminance line R1 which decreases linearly from the target value of phase inversion. The reference luminance stored in the reference luminance storage circuit 33*a* may also be, for example, a reference luminance line R2 (dashed line in FIG. 10) in which the luminance level decreases linearly to 0 after exceeding the target value, or a reference luminance line R3 (dashed line in FIG. 10) in which the luminance level decreases in a staircase pattern from the target value. In addition, the reference luminance stored in the reference luminance storage circuit 33*a* may also be a reference luminance line (not shown) in which the luminance level decreases before reaching the target value.

Moreover, in the foregoing third embodiment, while the luminance fluctuation detection circuit 21*a* is provided to the display control circuit 11*b* which comprises the enabling period setting circuit 26*a* for setting the phase inversion enabling period, the present implementation is not limited thereto. For example, the luminance fluctuation detection circuit 21*a* of the third embodiment may also be provided to the display control circuit 11 of the first embodiment which does not comprise an enabling period setting circuit. In this modified embodiment, the comparison circuit 34*a* sets, as the target value of phase inversion, the point in time that a predetermined time has lapsed from the time that the high level signal was output from the inversion enabling signal generation circuit 23. The comparison circuit 34*a* counts, based on the vertical synchronizing signal, the elapsed time from the time that the high level signal was output from the inversion enabling signal generation circuit 23. When the counted time reaches a predetermined time, the comparison circuit 34*a* extracts the reference luminance corresponding to the elapsed time from such point in time, since it is deemed that the time has reached the target value of phase inversion, from the reference luminance line R1 stored in the reference luminance storage circuit 33*a*, and compares the extracted reference luminance and the difference value output from the luminance variation detection circuit 32. The comparison circuit 34*a* thereafter performs the same operation as the foregoing third embodiment.

In this modified embodiment also, since a reference luminance line R1, in which the reference luminance decreases, is used after the lapse of a predetermined time from the point in time that the comparison circuit 34*a* outputs a high level signal to the inversion enabling signal generation circuit 23, it is likely that a phase inversion enabling signal will be output after the lapse of a predetermined time from the previous phase inversion. Accordingly, it is possible to prevent the phase inversion enabling period from lapsing without a phase inversion enabling signal being output and, consequently, it is possible to more reliably prevent the generation of residual images. In this modified embodiment, the foregoing predetermined time corresponds to an example of the first period.

Fourth Embodiment

Figure 11:
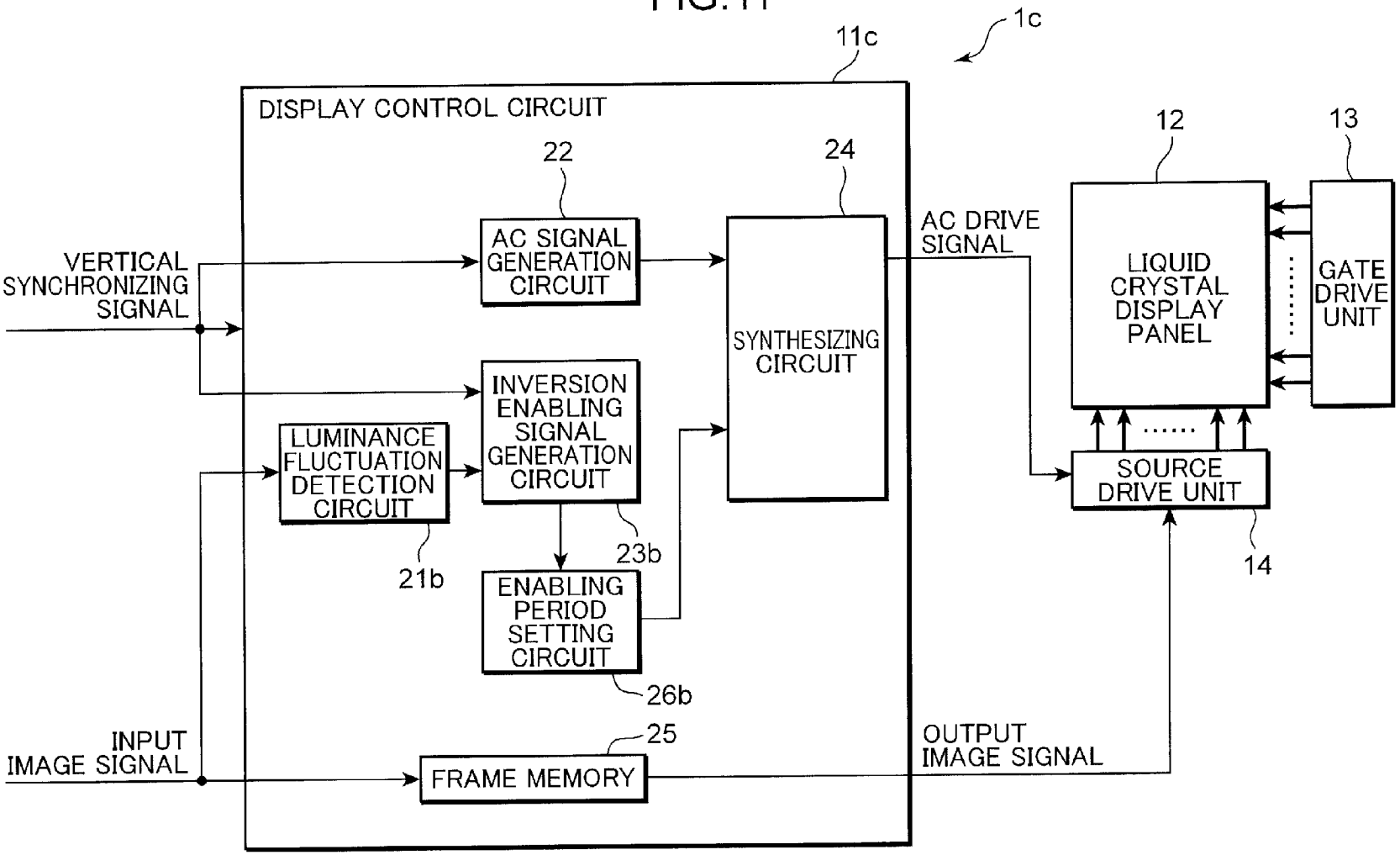
FIG. 11 is a block diagram showing a configuration of a liquid crystal display device according to a fourth embodiment of the instant application.
Figure 12:
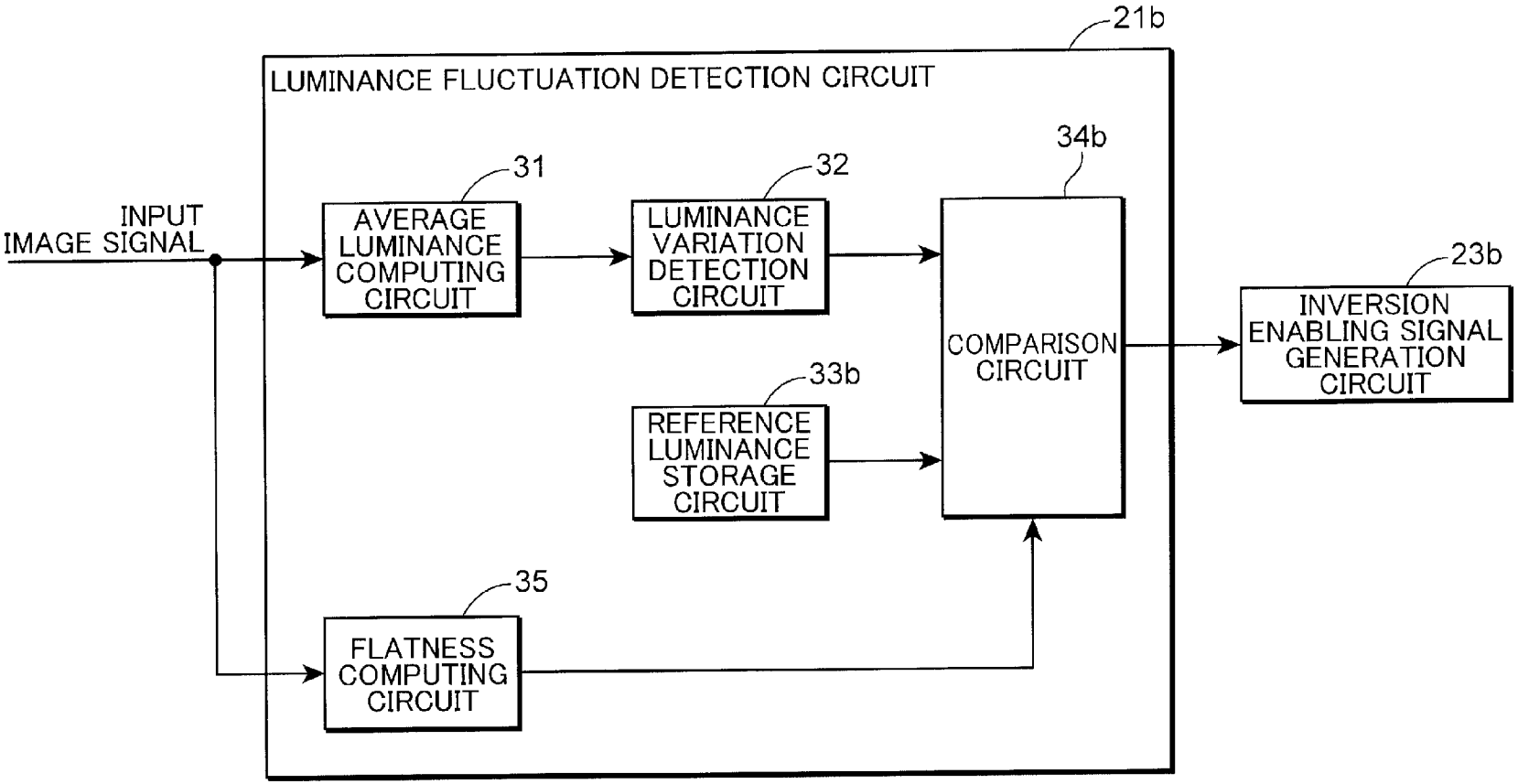
FIG. 12 is a block diagram showing a configuration of a luminance fluctuation detection circuit.
Figure 13:
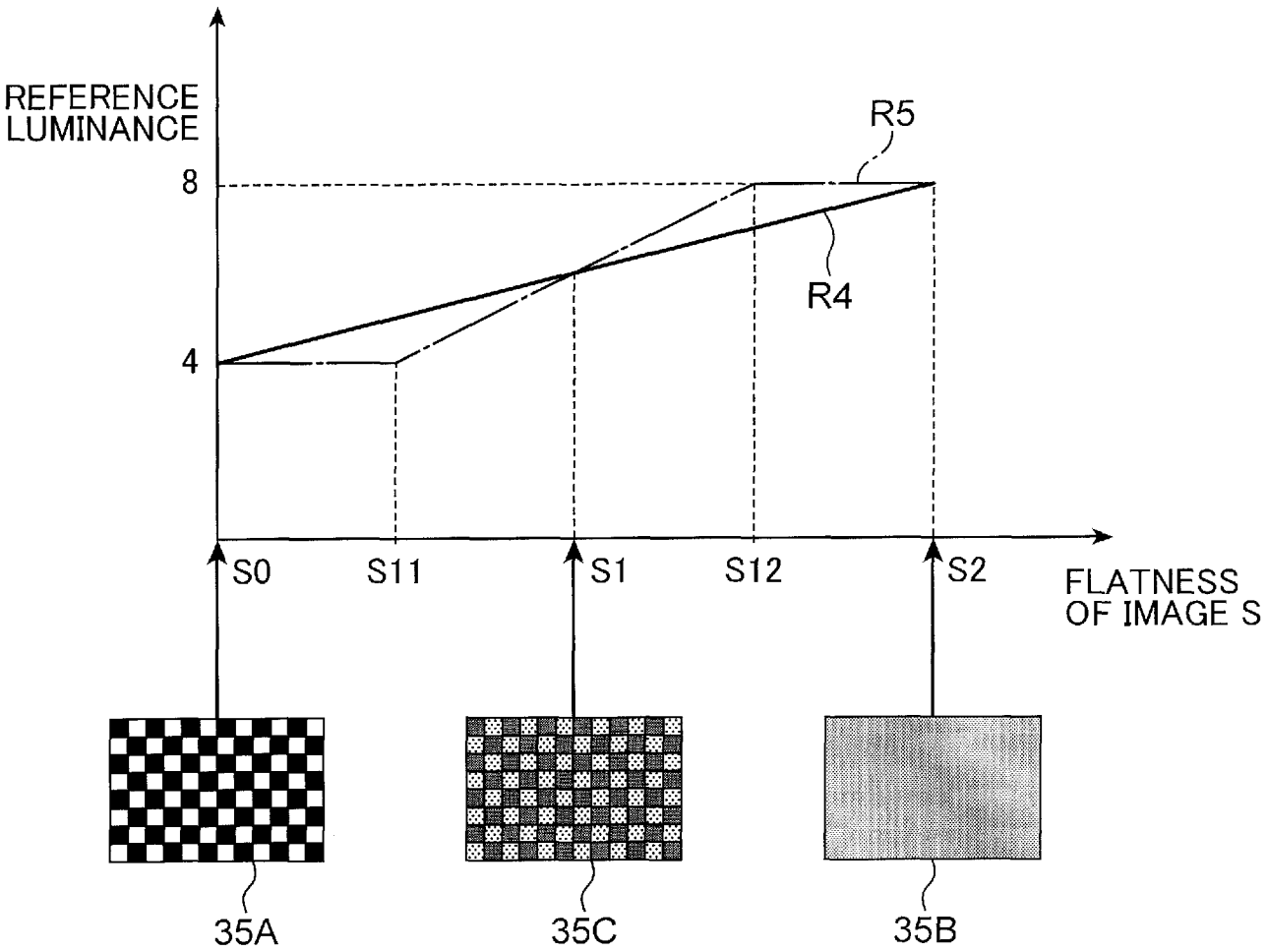
FIG. 13 is a diagram schematically showing a reference luminance stored in a reference luminance storage circuit.

FIG. 11 is a block diagram showing a configuration of a liquid crystal display device 1*c* according to a fourth embodiment of the instant application. FIG. 12 is a block diagram showing a configuration of a luminance fluctuation detection circuit 21*b*. FIG. 13 is a diagram schematically showing the reference luminance stored in a reference luminance storage circuit 33*b*. In the fourth embodiment, the same reference numeral is given to the same element as the first and second embodiments, and the fourth embodiment is now described mainly around the differences with the first and second embodiments.

The liquid crystal display device 1*c* of the fourth embodiment comprises a display control circuit 11*c*, in substitute for the display control circuit 11, in the liquid crystal display device 1 of the first embodiment shown in FIG. 1. The display control circuit 11*c* additionally comprises an enabling period setting circuit 26*b*, further comprises a luminance fluctuation detection circuit 21*b* in substitute for the luminance fluctuation detection circuit 21, and further comprises an inversion enabling signal generation circuit 23*b* in substitute for the inversion enabling signal generation circuit 23 in the display control circuit 11 shown in FIG. 1. The luminance fluctuation detection circuit 21*b* comprises, in the luminance fluctuation detection circuit 21 shown in FIG. 2, a reference luminance storage circuit 33*b* in substitute for the reference luminance storage circuit 33, and a comparison circuit 34*b* in substitute for the comparison circuit 34.

In FIG. 11, the inversion enabling signal generation circuit 23*b* outputs a phase inversion enabling signal to the enabling period setting circuit 26*b*, when the comparison circuit 34*b* of the luminance fluctuation detection circuit 21*b* outputs a high level signal as described later. As with the enabling period setting circuit 26 of the second embodiment, the enabling period setting circuit 26*b* sets the phase inversion enabling period as a period of enabling the phase inversion of the polarity in the AC drive signal. Moreover, when the phase inversion enabling signal is output from the inversion enabling signal generation circuit 23*b* during the set phase inversion enabling period, the enabling period setting circuit 26*b* outputs, to the synthesizing circuit 24, the phase inversion enabling signal that was output from the inversion enabling signal generation circuit 23*b*.

In FIG. 12, the flatness computing circuit 35 obtains a flatness S of the image displayed on the liquid crystal display panel 12 based on the input image signal. The flatness computing circuit 35 obtains, as the foregoing flatness S, for instance, a value obtained by subtracting the difference value of the maximum value and the minimum value of the signal levels in the input image signal from the maximum value (255 in the case of 8 bits) of the input image signal. For example, in FIG. 13, if the foregoing difference value of the image 35A is 255, the flatness S0=0 is obtained. Moreover, if the foregoing difference value of the image 35B is 0, flatness S2=255 is obtained. Moreover, if the foregoing difference value of the image 35C is 128, flatness S1=127 is obtained. The flatness computing circuit 35 outputs the obtained flatness S to the comparison circuit 34*b*.

The reference luminance storage circuit 33 of the first embodiment stores a reference luminance of a constant value. Meanwhile, the reference luminance storage circuit 33*b* of the fourth embodiment stores, as shown in FIG. 13, a reference luminance in which the value changes according to the flatness S of the image. In other words, the reference luminance line R4 (solid line in FIG. 13) stored in the reference luminance storage circuit 33*b* is set to become, for example, the reference luminance 8, which is the same as the first embodiment, with the flatness S2 of the image, and linearly decrease as the value of the flatness S becomes smaller and, with the flatness S0 of the image, to become the reference luminance 4. As shown in FIG. 13, when the flatness S is lower than the flatness S1, the reference luminance is decreased in comparison to a case when the flatness S is not less than the flatness S1.

The comparison circuit 34*b* extracts the reference luminance corresponding to the value of the flatness, which is output from the flatness computing circuit 35, from the reference luminance line R4 stored in the reference luminance storage circuit 33*b*, and compares the extracted reference luminance and the difference value output from the luminance variation detection circuit 32. As with the comparison circuit 34 of the first embodiment, the comparison circuit 34*b* outputs, for example, a high level signal to the inversion enabling signal generation circuit 23*b* when the difference value output from the luminance variation detection circuit 32 is greater than the reference luminance extracted from the reference luminance line R4 stored in the reference luminance storage circuit 33*b*, and outputs a low level signal to the inversion enabling signal generation circuit 23*b* when the foregoing difference value is not greater than the foregoing reference luminance. In other words, as with the comparison circuit 34 of the first embodiment, the comparison circuit 34*b* outputs, to the inversion enabling signal generation circuit 23*b*, a signal capable of differentiating the magnitude relationship of the foregoing difference value and the foregoing reference luminance. In this embodiment, the liquid crystal display panel 12 corresponds to an example of the liquid crystal display unit, the source drive unit 14 corresponds to an example of the drive unit, the luminance fluctuation detection circuit 21*b* corresponds to an example of the luminance determination unit, the inversion enabling signal generation circuit 23*b* corresponds to an example of the signal generation unit, and the enabling period setting circuit 26*b* corresponds to an example of the setting unit. Moreover, in this embodiment, the comparison circuit 34*b* corresponds to an example of the second reference changing unit, the flatness computing circuit 35 corresponds to an example of the flatness computing unit, and the flatness S1 corresponds to an example of the first threshold value.

As described above, in this fourth embodiment, the reference luminance line R4, which is set so that the reference luminance decreases when the flatness S of the image increases, is stored in the reference luminance storage circuit 33*b*, the flatness S of the image is obtained, and a reference luminance according to the obtained flatness S is used. Since the change in luminance caused by phase inversion is conspicuous in an image with a high flatness S, it is preferable that the reference luminance is increased. Contrarily, since the change in luminance caused by phase inversion is not conspicuous in an image with a low flatness S, there is no drawback even if the reference luminance is decreased and the phase inversion enabling signal is easily generated. Accordingly, in this fourth embodiment, it is possible to generate a phase inversion enabling signal using a reference luminance in accordance with the level of conspicuousness of the change in luminance caused by phase inversion.

Note that the reference luminance stored in the reference luminance storage circuit 33*b* is not limited to the reference luminance line R4 in which the luminance level changes linearly according to the flatness S. The reference luminance stored in the reference luminance storage circuit 33*b* may also be, for example, a reference luminance line R5 (dashed line in FIG. 13) which is set to be a constant reference luminance 8, for instance, in a high range of the flatness S (S12 or higher), which linearly decreases as the value of the flatness S decreases when the flatness S is S12>S>S11, and which is set to be a constant reference luminance 4, for instance, in a low range of the flatness S (S11 or lower).

Moreover, in the foregoing fourth embodiment, while the luminance fluctuation detection circuit 21*b* is provided to the display control circuit 11*c* which comprises the enabling period setting circuit 26*b* for setting the phase inversion enabling period, the present implementation is not limited thereto. For example, the luminance fluctuation detection circuit 21*b* of the fourth embodiment may also be provided to the display control circuit 11 of the first embodiment which does not comprise an enabling period setting circuit. In this embodiment also, it is possible to generate phase inversion enabling signal using a reference luminance in accordance with the level of conspicuousness of the change in luminance caused by the phase inversion.

Fifth Embodiment

Figure 14:
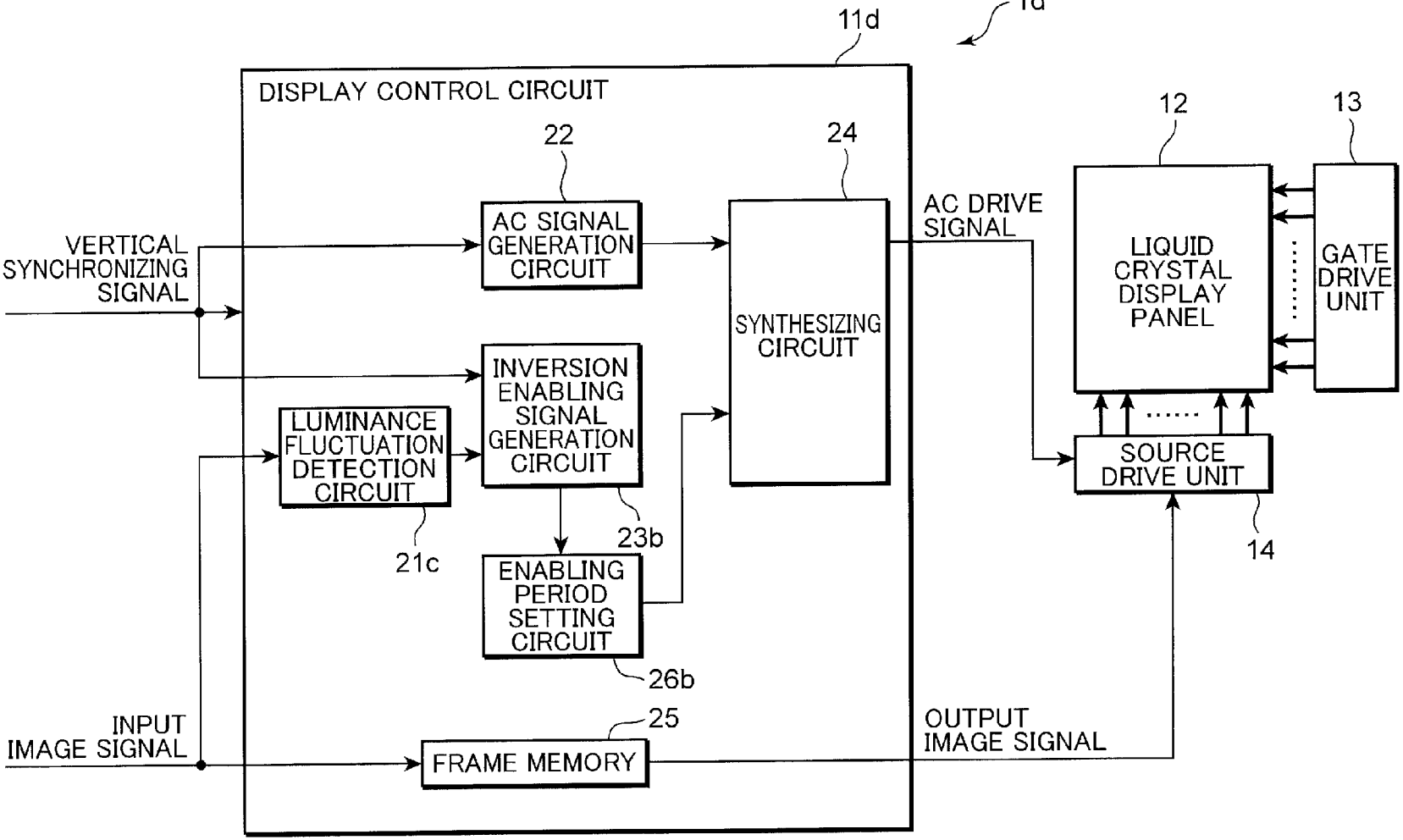
FIG. 14 is a block diagram showing a configuration of a liquid crystal display device according to a fifth embodiment of the instant application.
Figure 15:
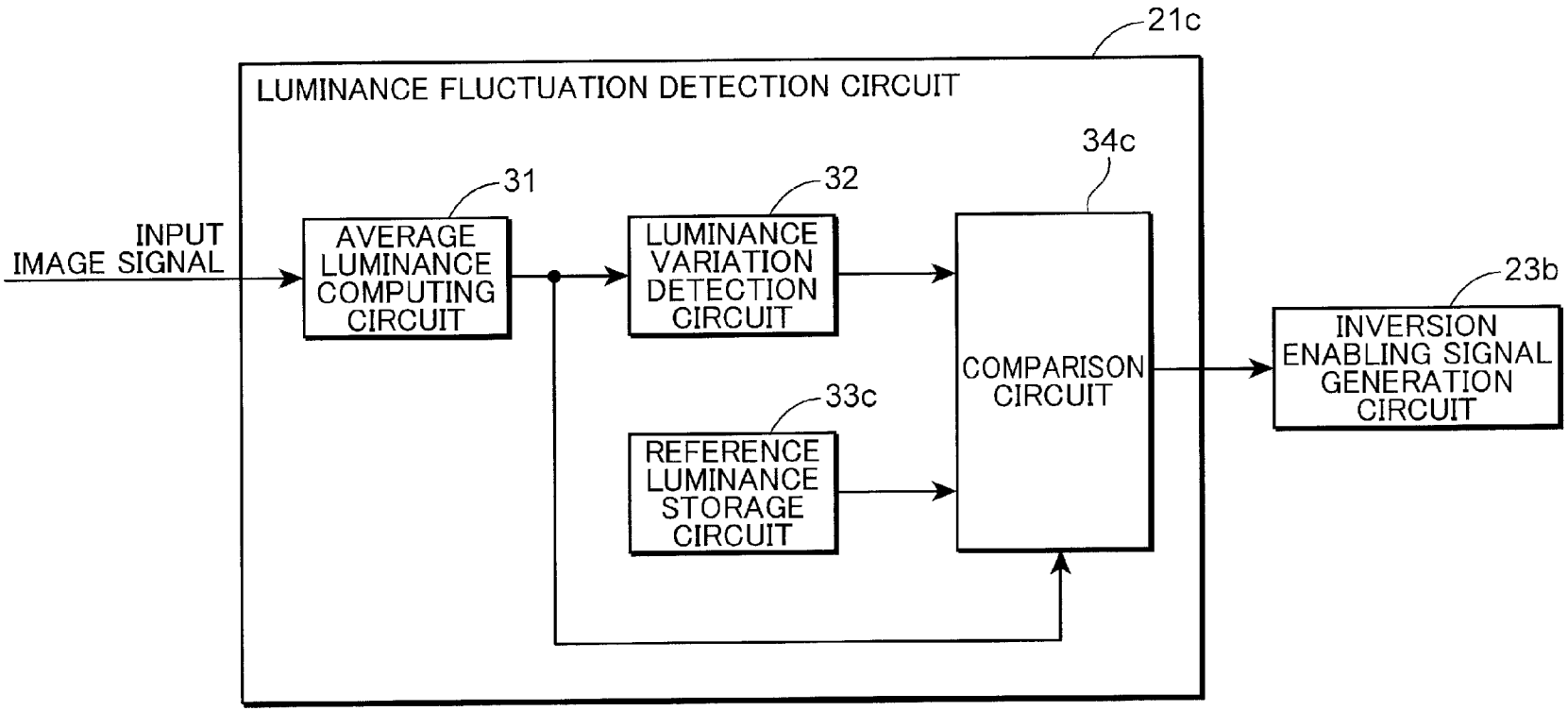
FIG. 15 is a block diagram showing a configuration of a luminance fluctuation detection circuit.
Figure 16:
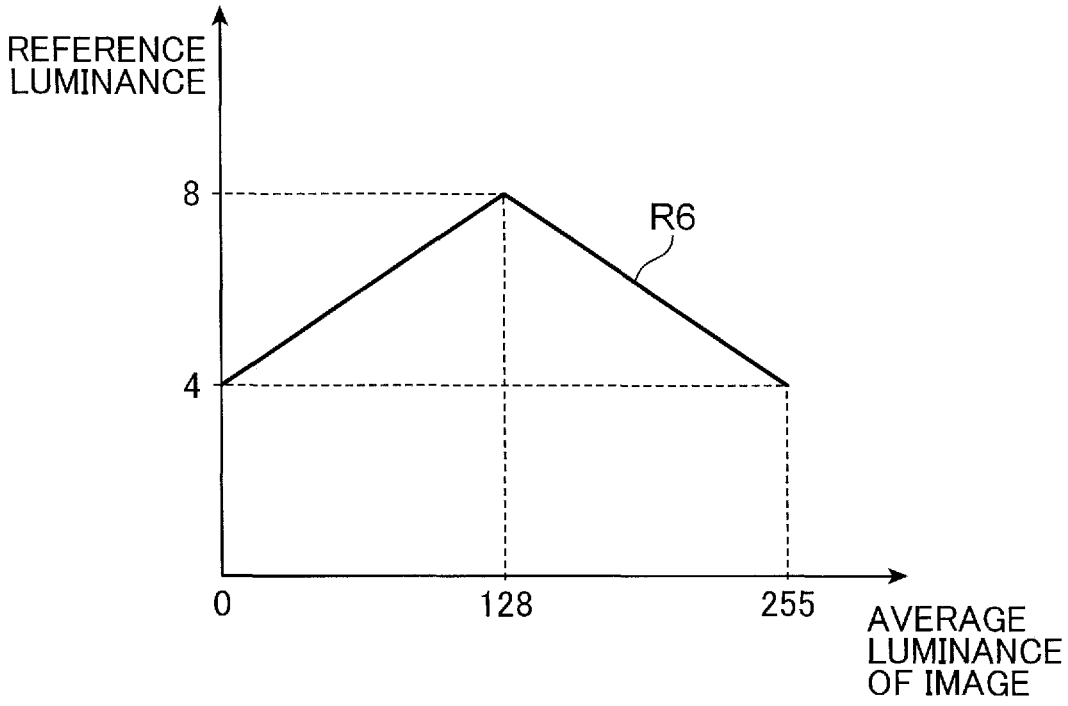
FIG. 16 is a diagram schematically showing a reference luminance stored in a reference luminance storage circuit.

FIG. 14 is a block diagram showing a configuration of a liquid crystal display device 1*d* according to a fifth embodiment of the instant application. FIG. 15 is a block diagram showing a configuration of a luminance fluctuation detection circuit 21*c*. FIG. 16 is a diagram schematically showing the reference luminance stored in a reference luminance storage circuit 33*c*. In the fifth embodiment, the same reference numeral is given to the same element as the first and second embodiments, and the fifth embodiment is now described mainly around the differences with the first and second embodiments.

The liquid crystal display device 1*d* of the fifth embodiment comprises a display control circuit 11*d*, in substitute for the display control circuit 11, in the liquid crystal display device 1 of the first embodiment shown in FIG. 1. The display control circuit 11*d* additionally comprises an enabling period setting circuit 26*b*, further comprises a luminance fluctuation detection circuit 21*c* in substitute for the luminance fluctuation detection circuit 21, and further comprises an inversion enabling signal generation circuit 23*b* in substitute for the inversion enabling signal generation circuit 23 in the display control circuit 11 shown in FIG. 1. The luminance fluctuation detection circuit 21*c* comprises, in the luminance fluctuation detection circuit 21 shown in FIG. 2, a reference luminance storage circuit 33*c* in substitute for the reference luminance storage circuit 33, and a comparison circuit 34*c* in substitute for the comparison circuit 34.

In FIG. 15, the inversion enabling signal generation circuit 23*b* outputs a phase inversion enabling signal to the enabling period setting circuit 26*b* when the comparison circuit 34*c* of the luminance fluctuation detection circuit 21*c* outputs a high level signal as described later. As with the enabling period setting circuit 26 of the second embodiment, the enabling period setting circuit 26*b* sets the phase inversion enabling period as a period of enabling the phase inversion of the polarity in the AC drive signal. Moreover, when the phase inversion enabling signal is output from the inversion enabling signal generation circuit 23*b* during the set phase inversion enabling period, the enabling period setting circuit 26*b* outputs, to the synthesizing circuit 24, the phase inversion enabling signal that was output from the inversion enabling signal generation circuit 23*b*. In the fifth embodiment, the average luminance computing circuit 31 also outputs the obtained average luminance to the comparison circuit 34*c*.

The reference luminance storage circuit 33 of the first embodiment stores a reference luminance of a constant value. Meanwhile, the reference luminance storage circuit 33*c* of the fifth embodiment stores, as shown in FIG. 16, a reference luminance in which the value changes according to the average luminance of the image. In other words, a reference luminance line R6, stored in the reference luminance storage circuit 33*c*, is set to a predetermined value (for example, set to the reference luminance 8 which is the same as the first embodiment) when the average luminance of the image is 128, decreases as the average luminance increases or decreases from 128, and is set to a predetermined value (for example, the reference luminance 4) when the average luminance is a minimum value of 0 and a maximum value of 255. Note that, in this embodiment, the average luminance is represented with 8 bits (0 to 255).

The comparison circuit 34*c* extracts the reference luminance corresponding to the average luminance, which is output from the average luminance computing circuit 31, from the reference luminance line R6 stored in the reference luminance storage circuit 33*c*, and compares the extracted reference luminance and the difference value output from the luminance variation detection circuit 32. As with the comparison circuit 34 of the first embodiment, the comparison circuit 34*c* outputs, for example, a high level signal to the inversion enabling signal generation circuit 23*b* when the difference value output from the luminance variation detection circuit 32 is greater than the reference luminance extracted from the reference luminance line R6 stored in the reference luminance storage circuit 33*c*, and outputs a low level signal to the inversion enabling signal generation circuit 23*b* when the foregoing difference value is not greater than the foregoing reference luminance. In other words, as with the comparison circuit 34 of the first embodiment, the comparison circuit 34*c* outputs, to the inversion enabling signal generation circuit 23*b*, a signal capable of differentiating the magnitude relationship of the foregoing difference value and the foregoing reference luminance. In this embodiment, the liquid crystal display panel 12 corresponds to an example of the liquid crystal display unit, the source drive unit 14 corresponds to an example of the drive unit, the luminance fluctuation detection circuit 21*c* corresponds to an example of the luminance determination unit, the inversion enabling signal generation circuit 23*b* corresponds to an example of the signal generation unit, and the enabling period setting circuit 26*b* corresponds to an example of the setting unit. Moreover, in this embodiment, the comparison circuit 34*c* corresponds to an example of the third reference changing unit.

As described above, in this fifth embodiment, a reference luminance line R6, which is set so that the reference luminance decreases as the average luminance deviates from the average value (128 in this fifth embodiment) of the maximum value (255 in this fifth embodiment) and the minimum value (0 in this fifth embodiment), is stored in the reference luminance storage circuit 33*c*, and a reference luminance according to the average luminance of the image is used. The variation width of the luminance caused by the phase inversion is small with a value in which the average luminance is near the maximum value and the minimum value, and contrarily the variation width of the luminance caused by the phase inversion is large with a value in which the average luminance is near the average value of the maximum value and the minimum value. Accordingly, in this fifth embodiment, it is possible to generate a phase inversion enabling signal using an appropriate reference luminance according to the variation width of the luminance caused by the phase inversion.

Note that, in the foregoing fifth embodiment, while the luminance fluctuation detection circuit 21*c* is provided to the display control circuit 11*d* which comprises the enabling period setting circuit 26*b* for setting the phase inversion enabling period, the present implementation is not limited thereto. For example, the luminance fluctuation detection circuit 21*c* of the fifth embodiment may also be provided to the display control circuit 11 of the first embodiment which does not comprise an enabling period setting circuit. In this embodiment also, it is possible to generate phase inversion enabling signal using a reference luminance in accordance with the variation width of the luminance caused by the phase inversion.

Sixth Embodiment

Figure 17:
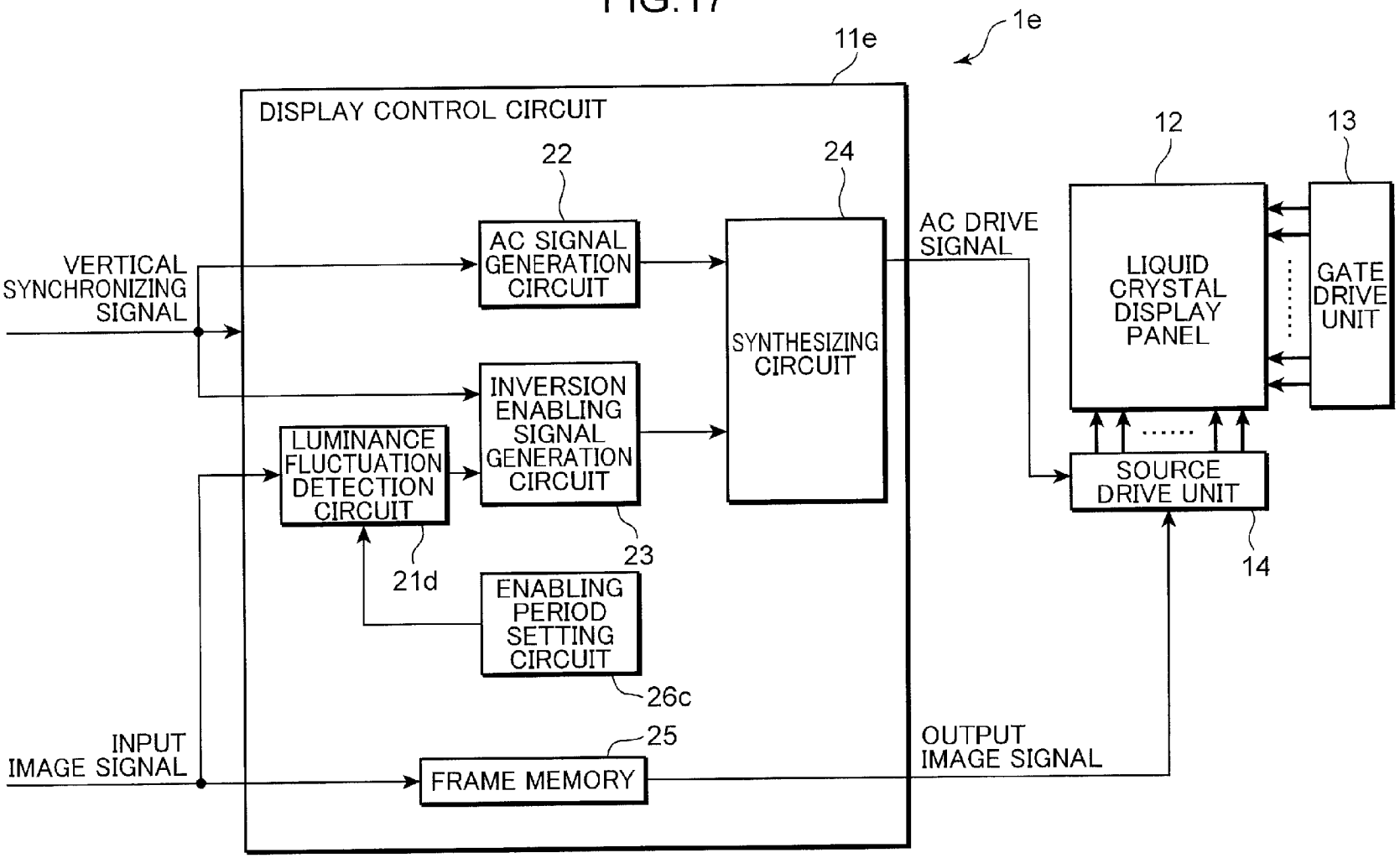
FIG. 17 is a block diagram showing a configuration of a liquid crystal display device according to a sixth embodiment of the instant application.
Figure 18:
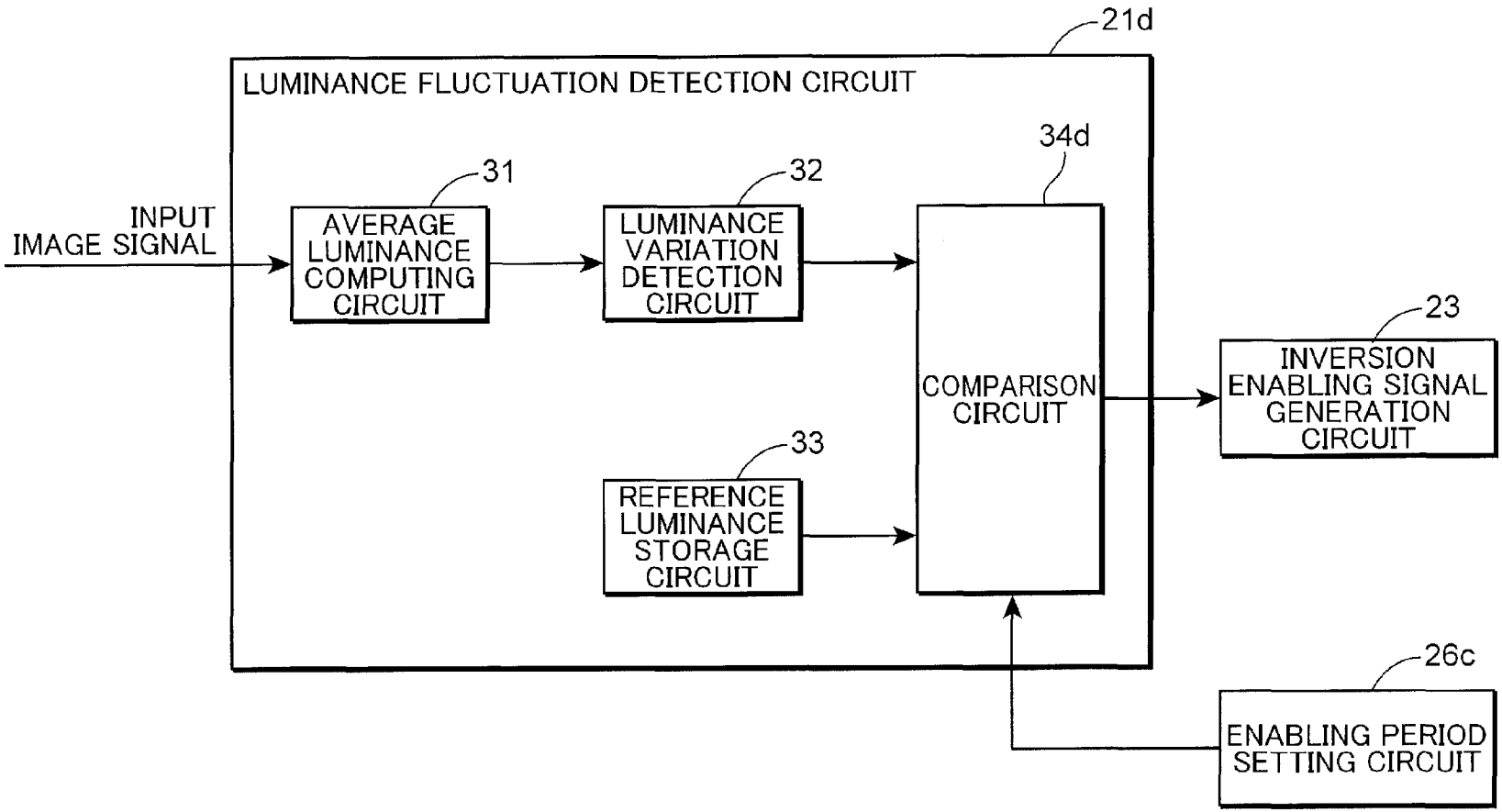
FIG. 18 is a block diagram showing a configuration of a luminance fluctuation detection circuit.
Figure 19:
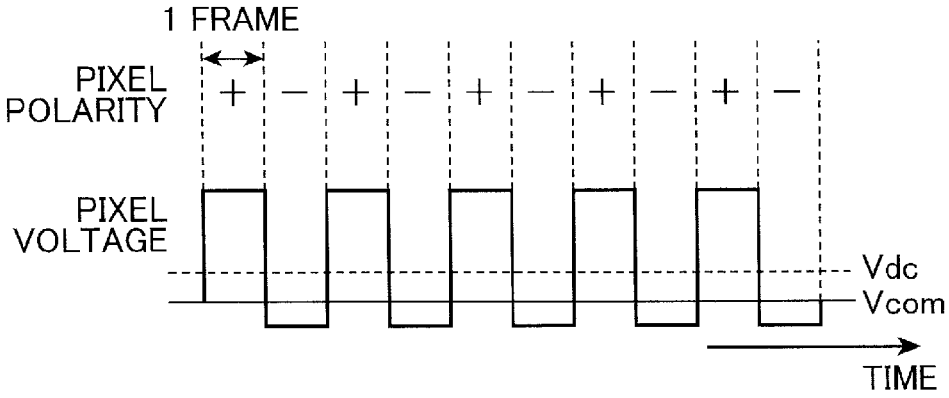
PRIOR ART FIG.19
FIG. 19 is a timing chart showing a pixel voltage in a case where a white image and a black image are alternately displayed per frame in the AC voltage drive.
Figure 20:
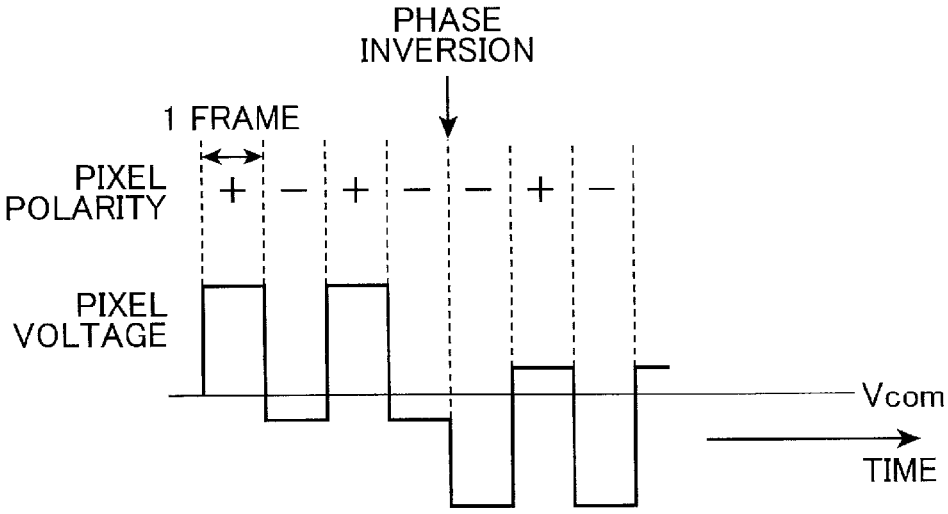
PRIOR ART FIG.20
FIG. 20 is a timing chart showing a pixel voltage in a case where, when a white image and a black image are alternately displayed per frame in the AC voltage drive, phase inversion is performed.
Figure 21:
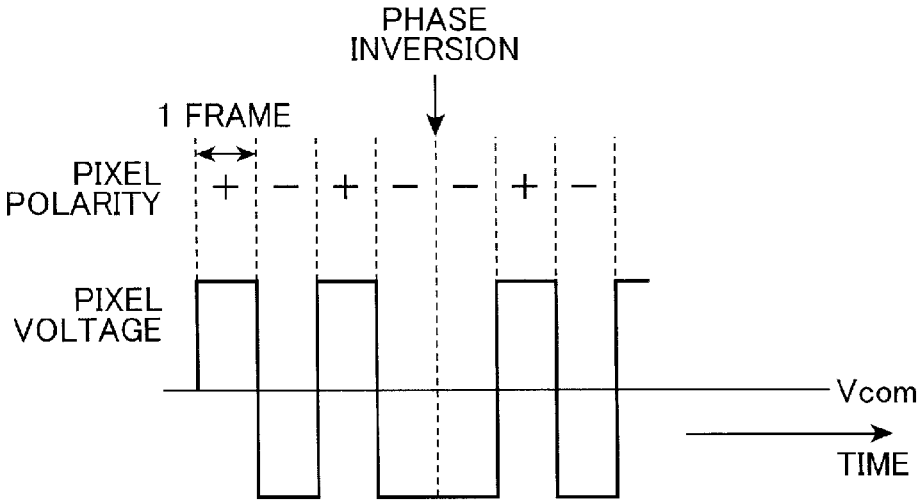
PRIOR ART FIG.21
FIG. 21 is a timing chart showing a pixel voltage in a case where, when an image with a constant luminance is displayed per frame in the AC voltage drive, phase inversion is performed.
Figure 22:
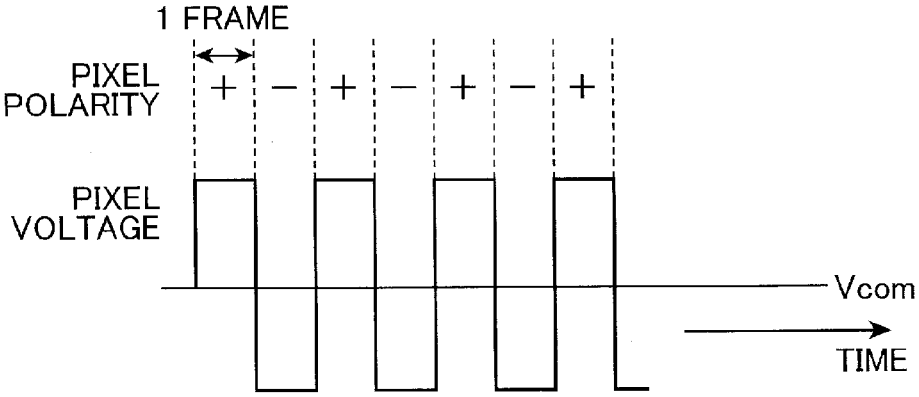
PRIOR ART FIG.22
FIG. 22 is a timing chart showing a pixel voltage in a case where an image with a constant luminance is displayed per frame in the AC voltage drive.

FIG. 17 is a block diagram showing a configuration of a liquid crystal display device 1*e* according to a sixth embodiment of the instant application. FIG. 18 is a block diagram showing a configuration of a luminance fluctuation detection circuit 21*d*. In the sixth embodiment, the same reference numeral is given to the same element as the first and second embodiments, and the sixth embodiment is now described mainly around the differences with the first and second embodiments.

The liquid crystal display device 1*e* of the sixth embodiment comprises a display control circuit 11*e*, in substitute for the display control circuit 11, in the liquid crystal display device 1 of the first embodiment shown in FIG. 1. The display control circuit 11*e* additionally comprises an enabling period setting circuit 26*c*, and further comprises a luminance fluctuation detection circuit 21*d* in substitute for the luminance fluctuation detection circuit 21 in the display control circuit 11 shown in FIG. 1. The luminance fluctuation detection circuit 21*d* comprises a comparison circuit 34*d* in substitute for the comparison 34 in the luminance fluctuation detection circuit 21 shown in FIG. 2.

In FIG. 17, as with the enabling period setting circuit 26 of the second embodiment, the enabling period setting circuit 26*c* sets the phase inversion enabling period as a period of enabling the phase inversion of the polarity in the AC drive signal. Moreover, the enabling period setting circuit 26*c* notifies the information related to the set phase inversion enabling period to the comparison circuit 34*d* of the luminance fluctuation detection circuit 21*d*.

The comparison circuit 34*d* compares the reference luminance stored in the reference luminance storage circuit 33 and the difference value output from the luminance variation detection circuit 32 only in the phase inversion enabling period notified by the enabling period setting circuit 26*c*. As with the comparison circuit 34 of the first embodiment, the comparison circuit 34*d* outputs, for example, a high level signal to the inversion enabling signal generation circuit 23 when the difference value output from the luminance variation detection circuit 32 is greater than the reference luminance stored in the reference luminance storage circuit 33, and outputs a low level signal to the inversion enabling signal generation circuit 23 when the foregoing difference value is not greater than the foregoing reference luminance. In other words, as with the comparison circuit 34 of the first embodiment, the comparison circuit 34*d* outputs, to the inversion enabling signal generation circuit 23, a signal capable of differentiating the magnitude relationship of the foregoing difference value and the foregoing reference luminance. In this embodiment, the liquid crystal display panel 12 corresponds to an example of the liquid crystal display unit, the source drive unit 14 corresponds to an example of the drive unit, the luminance fluctuation detection circuit 21*d* corresponds to an example of the luminance determination unit, the inversion enabling signal generation circuit 23 corresponds to an example of the signal generation unit, and the enabling period setting circuit 26*c* corresponds to an example of the setting unit.

As described above, in this sixth embodiment, the comparison circuit 34*d* compares the reference luminance and the difference value only in the phase inversion enabling period. Accordingly, the inversion enabling signal generation circuit 23 will output a phase inversion enabling signal only in the phase inversion enabling period. Thus, according to the sixth embodiment, as with the second embodiment, it is possible to adjust the phase inversion cycle, while avoiding the implementation of the phase inversion of the AC drive signal, each time the variation in the luminance average value of the input image signal exceeds the reference luminance.

The specific embodiments described above mainly include the liquid crystal display device configured as described below.

In one general aspect, the instant application describes a liquid crystal display device that includes: a liquid crystal display unit that includes pixels and displays an image based on an input image signal input for each of frames; a drive unit that applies a voltage based on the input image signal to the pixels of the liquid crystal display unit while inverting a polarity of the voltage for each of the frames; a luminance determination unit that detects, for each of the frames, an average luminance of the image displayed on the liquid crystal display unit, and determines whether the detected average luminance has changed, between the frames adjacent to each other, by an amount equal to or more than a predetermined reference luminance; and a signal generation unit that generates a phase inversion enabling signal for inverting a phase of the polarity of the voltage applied to the pixels, in a case where the luminance determination unit determines that the average luminance has changed by the amount equal to or more than the reference luminance. The drive unit inverts the phase of the polarity of the voltage applied to the pixels when the phase inversion enabling signal is generated by the signal generation unit.

According to the foregoing configuration, the liquid crystal display unit includes pixels and displays an image based on an input image signal input for each of frames. The drive unit applies a voltage based on the input image signal to the pixels of the liquid crystal display unit while inverting a polarity of the voltage for each of the frames. The luminance determination unit detects, for each of the frames, an average luminance of the image displayed on the liquid crystal display unit, and determines whether the detected average luminance has changed, between the frames adjacent to each other, by an amount equal to or more than a predetermined reference luminance. The signal generation unit generates a phase inversion enabling signal for inverting a phase of the polarity of the voltage applied to the pixels, in a case where the luminance determination unit determines that the average luminance has changed by the amount equal to or more than the reference luminance. The drive unit inverts the phase of the polarity of the voltage applied to the pixels when the phase inversion enabling signal is generated by the signal generation unit. As described above, since the phase of the polarity of the voltage applied to the pixels is inverted when the average luminance of the image is determined to have changed by the amount equal to or more than the reference luminance, the change in luminance caused by inverting the phase of the polarity of the voltage applied to the pixels will not be conspicuous. Consequently, it is possible to prevent the deterioration in the display quality of images while preventing the generation of residual images.

The above general aspect may include one or more of the following features. The liquid crystal display device may further include a first reference changing unit that decreases the reference luminance in a case where the drive unit does not perform an operation of inverting the phase of the polarity of the voltage for a predetermined first period.

According to the foregoing configuration, the first reference changing unit decreases the reference luminance in a case where the drive unit does not perform an operation of inverting the phase of the polarity of the voltage for a predetermined first period. Accordingly, since the reference luminance is decreased after elapse of the first period, it becomes easier to generate a phase inversion enabling signal. Consequently, it is possible to more reliably invert the phase of the polarity of the voltage applied to the pixels, and more reliably prevent the generation of residual images.

The signal generation unit coercively generates the phase inversion enabling signal in a case where the drive unit does not perform an operation of inverting the phase of the polarity of the voltage for a predetermined second period.

According to the foregoing configuration, the signal generation unit coercively generates the phase inversion enabling signal in a case where the drive unit does not perform an operation of inverting the phase of the polarity of the voltage for a predetermined second period. Accordingly, it is possible to reliably invert the phase of the polarity of the voltage applied to the pixels by the time the second period elapses from the operation of the previous phase inversion. Consequently, it is possible to reliably prevent the generation of residual images.

The liquid crystal display device may further include: a flatness computing unit that calculates a flatness of the image, which is based on the input image signal, based on a signal level of the input image signal of the pixels in the frame; and a second reference changing unit that decreases the reference luminance, which is used in a case where the flatness calculated by the flatness computing unit is less than a predetermined first threshold value, in comparison to the reference luminance, which is used in a case where the flatness calculated by the flatness computing unit is not less than the first threshold value.

According to the foregoing configuration, the flatness computing unit calculates a flatness of the image, which is based on the input image signal, based on a signal level of the input image signal of the pixels in the frame. The second reference changing unit decreases the reference luminance, which is used in a case where the flatness calculated by the flatness computing unit is less than a predetermined first threshold value, in comparison to the reference luminance, which is used in a case where the flatness calculated by the flatness computing unit is not less than the first threshold value. When the flatness of the image is lower than the first threshold value, in comparison to a case where the flatness of the image is not lower than the first threshold value, the change in luminance upon inverting the phase of the polarity of the voltage applied to the pixels will not be conspicuous. Accordingly, by causing a phase inversion enabling signal to be generated more easily when the flatness of the image is lower than the first threshold value, it is possible to reliably invert the phase of the polarity of the voltage applied to the pixels without the change in luminance becoming conspicuous. Consequently, it is possible to prevent the deterioration in the display quality of images while reliably preventing the generation of residual images.

The liquid crystal display device may further include a third reference changing unit that decreases, when the luminance of the image displayed on the liquid crystal display unit is a value within a range from a predetermined minimum value to a predetermined maximum value, the reference luminance, which is used in a case where the average luminance detected by the luminance determination unit is higher than an average value of the minimum value and the maximum value, in comparison to the reference luminance, which is used in a case where the average luminance is equal to the average value, and decreases the reference luminance, which is used in a case where the average luminance detected by the luminance determination unit is lower than an average value of the minimum value and the maximum value, in comparison to the reference luminance, which is used in a case where the average luminance is equal to the average value.

According to the foregoing configuration, when the luminance of the image displayed on the liquid crystal display unit is a value within a range from a predetermined minimum value to a predetermined maximum value, the third reference changing unit decreases the reference luminance, which is used in a case where the average luminance detected by the luminance determination unit is higher than an average value of the minimum value and the maximum value, in comparison to the reference luminance, which is used in a case where when average luminance is equal to the average value. Moreover, the third reference changing unit decreases the reference luminance, which is used in a case where the average luminance detected by the luminance determination unit is lower than an average value of the minimum value and the maximum value, in comparison to the reference luminance, which is used in a case where the average luminance is equal to the average value. The change in luminance upon inverting the phase of the polarity of the voltage applied to the pixels is greater in a case where the average luminance of the image is the average value of the minimum value and the maximum value in comparison to a case where the average luminance of the image is higher than the average value. Moreover, the change in luminance upon inverting the phase of the polarity of the voltage applied to the pixels is greater in a case where the average luminance of the image is equal to the average value in comparison to a case where the average value of the image is lower than the foregoing average value. Accordingly, when the average luminance of the image is higher than or lower than the foregoing average value, the reference luminance is decreased so that the phase inversion enabling signal can be more easily generated, whereby it is possible to reliably invert the phase of the polarity of the voltage applied to the pixels without the change in luminance becoming conspicuous. Consequently, it is possible to prevent the deterioration in the display quality of images while reliably preventing the generation of residual images.

The liquid crystal display device may further include a setting unit that sets a phase inversion enabling period as a period enabling an inversion of the phase of the polarity of the voltage applied to the pixels. The drive unit inverts the phase of the polarity of the voltage applied to the pixels only when the phase inversion enabling signal is generated by the signal generation unit during the phase inversion enabling period set by the setting unit, a cycle of inverting the phase of the polarity of the voltage applied to the pixels by the drive unit is defined as a phase inversion cycle, and the setting unit sets the phase inversion enabling period so that the values of the phase inversion cycles are substantially equal to each other.

According to the foregoing configuration, the setting unit sets a phase inversion enabling period as a period enabling an inversion of the phase of polarity of the voltage applied to the pixels. The drive unit inverts the phase of the polarity of the voltage applied to the pixels only when the phase inversion enabling signal is generated by the signal generation unit during the phase inversion enabling period set by the setting unit. A cycle of inverting the phase of the polarity of the voltage applied to the pixels by the drive unit is defined as a phase inversion cycle. The setting unit sets the phase inversion enabling period so that the values of the phase inversion cycles are substantially equal to each other. In a case where the phase inversion cycle of the same phase before inverting the phase of the polarity of the voltage applied to the pixels and the phase inversion cycle of the same phase after the phase inversion are not equivalent, a DC voltage will be applied to the pixels, and this causes the generation of residual images. Meanwhile, according to the foregoing configuration, the phase inversion enabling period is set so that the values of the phase inversion cycles are substantially equal to each other. Accordingly, it is possible to reliably eliminate the cause that will generate residual images.

The setting unit may set a subsequent phase inversion enabling period when the drive unit performs the operation of inverting the phase of the polarity of the voltage. According to the foregoing configuration, the setting unit sets a subsequent phase inversion enabling period when the drive unit performs the operation of inverting the phase of the polarity of the voltage. Accordingly, the phase inversion enabling period can be set easily so that the values of the phase inversion cycles are substantially equal to each other.

The luminance determination unit may determine whether the average luminance has changed by the amount equal to or more than the reference luminance only during the phase inversion enabling period set by the setting unit. According to the foregoing configuration, the luminance determination unit determines whether the average luminance has changed by the amount equal to or more than the reference luminance only during the phase inversion enabling period set by the setting unit. Accordingly, the signal generation unit will generate a phase inversion enabling signal only during the phase inversion enabling period. Consequently, the drive unit will invert the phase of the polarity of the voltage applied to the pixels only during the phase inversion enabling period set by the setting unit. Accordingly, it is possible to invert the phase of the polarity of the voltage applied to the pixels at an appropriate frequency.

INDUSTRIAL APPLICABILITY

The present implementation is useful as a liquid crystal display device capable of preventing the occurrence of residual images and preventing the deterioration in the display quality of images in a liquid crystal display device for displaying, on a liquid crystal display unit, an image corresponding to the input image signal.

This application is based on Japanese Patent application No. 2011-280351 filed in Japan Patent Office on Dec. 21, 2011, the contents of which are hereby incorporated by reference.

Although the present application has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A liquid crystal display device, comprising:

a liquid crystal display unit that includes pixels and displays an image based on an input image signal input for each of frames;

a drive unit that applies a voltage based on the input image signal to the pixels of the liquid crystal display unit while inverting a polarity of the voltage for each of the frames;

a luminance determination unit that detects, for each of the frames, an average luminance of the image displayed on the liquid crystal display unit, and determines whether the detected average luminance has changed, between the frames adjacent to each other, by an amount equal to or more than a reference luminance;

a signal generation unit that generates a phase inversion enabling signal for inverting a phase of the polarity of the voltage applied to the pixels, in a case where the luminance determination unit determines that the average luminance has changed by the amount equal to or more than the reference luminance, wherein the drive unit inverts the phase of the polarity of the voltage applied to the pixels when the phase inversion enabling signal is generated by the signal generation unit; and a first reference changing unit that decreases the reference luminance in a case where the drive unit does not perform an operation of inverting the phase of the polarity of the voltage for a predetermined first period.

2. The liquid crystal display device according to claim 1, wherein the signal generation unit coercively generates the phase inversion enabling signal in a case where the drive unit does not perform an operation of inverting the phase of the polarity of the voltage for a predetermined second period.

3. The liquid crystal display device according to claim 1, further comprising:

a flatness computing unit that calculates a flatness of the image, which is based on the input image signal, based on a signal level of the input image signal of the pixels in the frame; and a second reference changing unit that decreases the reference luminance, which is used in a case where the flatness calculated by the flatness computing unit is less than a predetermined first threshold value, in comparison to the reference luminance, which is used in a case where the flatness calculated by the flatness computing unit is not less than the first threshold value.

4. The liquid crystal display device according to claim 1, further comprising a third reference changing unit that decreases, when the luminance of the image displayed on the liquid crystal display unit is a value within a range from a predetermined minimum value to a predetermined maximum value, the reference luminance, which is used in a case where the average luminance detected by the luminance determination unit is higher than an average value of the minimum value and the maximum value, in comparison to the reference luminance, which is used in a case where the average luminance is equal to the average value, and decreases the reference luminance, which is used in a case where the average luminance detected by the luminance determination unit is lower than an average value of the minimum value and the maximum value, in comparison to the reference luminance, which is used in a case where the average luminance is equal to the average value.

5. The liquid crystal display device according to claim 1, further comprising a setting unit that sets a phase inversion enabling period as a period enabling an inversion of the phase of the polarity of the voltage applied to the pixels, wherein the drive unit inverts the phase of the polarity of the voltage applied to the pixels only when the phase inversion enabling signal is generated by the signal generation unit during the phase inversion enabling period set by the setting unit, a cycle of inverting the phase of the polarity of the voltage applied to the pixels by the drive unit is defined as a phase inversion cycle, and the setting unit sets the phase inversion enabling period so that the values of the phase inversion cycles are substantially equal to each other.

6. The liquid crystal display device according to claim 5, wherein the setting unit sets a subsequent phase inversion enabling period when the drive unit performs the operation of inverting the phase of the polarity of the voltage.

7. The liquid crystal display device according to claim 5, wherein the luminance determination unit determines whether the average luminance has changed by the amount equal to or more than the reference luminance only during the phase inversion enabling period set by the setting unit.

* * * * *